US008636265B1

(12) United States Patent
Soot

(10) Patent No.: US 8,636,265 B1
(45) Date of Patent: Jan. 28, 2014

(54) WINCH FOR RAISING AND LOWERING THEATER SCENERY

(76) Inventor: Olaf Soot, Greenwich, CT (US)

( * ) Notice: Subject to any disclaimer, the term of this patent is extended or adjusted under 35 U.S.C. 154(b) by 423 days.

(21) Appl. No.: 12/807,318

(22) Filed: Sep. 3, 2010

Related U.S. Application Data

(60) Provisional application No. 61/277,442, filed on Sep. 23, 2009.

(51) Int. Cl.
*B66D 3/08* (2006.01)

(52) U.S. Cl.
USPC ..... 254/394; 254/334; 254/336; 254/393

(58) Field of Classification Search
USPC ..... 254/334, 336, 338, 393–395
See application file for complete search history.

(56) References Cited

U.S. PATENT DOCUMENTS

| | | | | | |
|---|---|---|---|---|---|
| 1,821,563 | A * | 9/1931 | William et al. | ..... | 254/295 |
| 2,660,382 | A * | 11/1953 | Wilson | ..... | 242/478.2 |
| 3,623,620 | A * | 11/1971 | Vermette | ..... | 414/420 |
| 3,788,605 | A * | 1/1974 | Johnson | ..... | 254/361 |
| 4,324,386 | A * | 4/1982 | Gagnon et al. | ..... | 254/288 |
| 4,382,581 | A * | 5/1983 | Wimer et al. | ..... | 254/134.3 FT |
| 4,446,587 | A * | 5/1984 | Jump | ..... | 5/83.1 |
| 5,018,603 | A * | 5/1991 | Ito | ..... | 187/254 |
| 5,361,565 | A * | 11/1994 | Bayer | ..... | 254/292 |
| 5,713,296 | A * | 2/1998 | Gervasi et al. | ..... | 114/266 |
| 5,772,184 | A * | 6/1998 | Zaguroli, Jr. | ..... | 254/361 |
| 5,951,236 | A * | 9/1999 | Thompson | ..... | 414/607 |
| 6,520,485 | B1 * | 2/2003 | Soot | ..... | 254/331 |
| 6,634,622 | B1 * | 10/2003 | Hoffend, Jr. | ..... | 254/394 |
| 6,889,958 | B2 * | 5/2005 | Hoffend, Jr. | ..... | 254/276 |
| 7,258,325 | B2 * | 8/2007 | Hoffend, Jr. | ..... | 254/394 |
| 7,484,712 | B2 * | 2/2009 | Hossler | ..... | 254/331 |
| 7,562,863 | B2 * | 7/2009 | Kochan et al. | ..... | 254/394 |
| 7,766,308 | B2 * | 8/2010 | Kochan et al. | ..... | 254/394 |
| 8,002,243 | B2 * | 8/2011 | Murphy et al. | ..... | 254/278 |
| 2003/0030045 | A1 * | 2/2003 | Hoffend, Jr. | ..... | 254/288 |
| 2004/0089857 | A1 * | 5/2004 | Brestelli et al. | ..... | 254/323 |
| 2004/0099852 | A1 * | 5/2004 | Hoffend et al. | ..... | 254/331 |
| 2004/0099853 | A1 * | 5/2004 | Verakis | ..... | 254/343 |
| 2006/0163548 | A1 * | 7/2006 | Kochan et al. | ..... | 254/278 |
| 2006/0231814 | A1 * | 10/2006 | Birdsall et al. | ..... | 254/323 |
| 2009/0143001 | A1 * | 6/2009 | Godwin | ..... | 452/129 |

* cited by examiner

*Primary Examiner* — Emannuel M Marcelo
*Assistant Examiner* — Michael Gallion

(57) ABSTRACT

A motorized improved winch for raising and lowering, for example, theater scenery by means of cables and which incorporates a tubular support enclosure for supporting and housing a moving drum and the required components for emergency braking and for moving the drum in synchronization with relation to the cable guiding means, preferably mounted on the tubular support enclosure, and for driving the electrical sensors (limit switches and encoder) if desired. The winding and unwinding of the cables on or off the drum does not change the cable runs relative to the cable guiding means. The improved winch can be used in theaters and can be installed at the sides of the stage, up at the stage gridiron, or above the gridiron. With this improved winch counterweights are unnecessary. The improved winch is compact and can be easily manufactured.

19 Claims, 17 Drawing Sheets

WINCH FOR RAISING AND LOWERING THEATER SCENERY

This invention is based on U.S. Provisional Patent application 61/277,442 filed Sep. 23, 2009 and is directed to raising and lowering objects, in particular objects, such as theater scenic elements, suspended from fly sets, by improved fail-safe motorized means.

BACKGROUND OF INVENTION

In most theaters the scenery is hung from manually operated fly sets. Each set usually consists of a pipe batten hung parallel to the proscenium opening from cables approximately 8-12 ft. apart.

Each cable passes from the pipe batten over loft blocks, mounted on the gridiron or to the underside of the roof beams. From the loft blocks the cables lead over a common head-block, mounted at the side of the stage, usually approximately level with the loft blocks, and down to a counterweight arbor. The counterweight arbor is typically a steel frame, supporting lead, and steel or cast iron weights. It is guided by tracks or cables, which are mounted on the stage sidewall. The weight of the counterweight arbor is balanced to be approximately equal to the weight of the pipe batten and the set hung from the pipe batten.

The fly set is lifted or lowered by an operating rope, tied on top of the counterweight arbor, passing up over and around the head block, down around a tension sheave and up again through a friction lock to the bottom of the counterweight arbor. The friction lock holds the nearly balanced pipe batten and the counterweight arbor in position.

The pipe battens are usually spaced at 6 to 8 inches on centers. The number of sets varies. 20-30 may be used in smaller theaters while more than 100 in larger theaters. The system has several disadvantages. Loading and unloading counterweights for balancing the loads is time-consuming and dangerous. There have been many accidents when counterweights were dropped from a 60-80 feet above the stage. Also, in case of excessive unbalance the fly set may run away when the rope lock is opened.

Motorized winches have been used in larger theaters. In the past most of them have been one of a kind designs, developed specifically for the particular applications. More recently standardized winches have become available, but are still considerably more costly than the manually operated fly sets.

Motorized fly sets are generally spaced wider apart than the manual sets. 8 inch center-to-center spacing has become an accepted standard in the US. The standardized winches presently available are wider than 8 inches and therefore cannot be mounted side by side in a single row. Double row or staggered winch mounting is required for these winches for spacing the fly sets at 8-inch centers.

Some of the standardized fly set winches are zero fleet angle type, meaning that the angle of the cables between the cable drum and the loft block sheaves, mounted on the winch base, does not change when the cables wind or unwind on the drum. This feature is achieved by translating the drum in its longitudinal direction with respect to the sheaves, in synchronization with the back and forth travels of the cables in the drum cable grooves. As an alternate, the drum can be stationary and the loft block sheaves can be translated in similar manner with respect to the drum. This translation can be accomplished by a screw, with the thread pitch identical or in fixed ratio with the spacing of the cable grooves in the drum. The screw can be non-rotatably mounted to the winch base. It would engage a rotating nut, part of the winch. As an option the screw can be rotatably mounted on the winch engaging a fixed nut mounted on the winch base. As another option, the grooves in the winch drum can be used for translating the drum in its longitudinal direction through a device such as a rotating cam or wheel mounted on the winch base and engaging the drum grooves. In this case the drum grooves act as screw thread.

All the existing above described winches are mounted on external base structures and use separate protective enclosures around the winch moving parts.

BRIEF SUMMARY OF INVENTION

An object of the present invention is an improved winch that combines the functions of the winch base structure and a protective winch enclosure into a single component tubular support enclosure.

Another object of the present invention is an improved zero fleet angle winch, where the tubular support enclosure includes means for mounting the winch unit inside the tubular support enclosure such that it or its drum can be moved back and forth parallel to its longitudinal axis inside the tubular support enclosure.

A further object of the present invention is an improved zero fleet angle winch configured in such manner that the motor, gear reducer and an over-speed brake, part of the winch unit, all mounted inside the tubular support enclosure, are accessible for maintenance or replacement without removing the winch unit from its tubular support enclosure or from its mounted location in the facility.

Yet another object of the invention is an improved winch zero fleet angle winch is compact and sufficiently versatile that it can be easily adapted for mounting along the theater sidewalls or to the gridiron or to the overhead structure and where the winches can be mounted at approximately 8" on centers with respect to each other.

A principal feature of this invention is a winch construction of which the winch unit is mounted inside a tubular support enclosure that supports and guides the winch unit while providing access to movable components of the winch unit for maintenance and repair. In a preferred embodiment, a sheave assembly and a sensor unit are mounted on the bottom side of the tubular support enclosure. In a preferred embodiment, the control sensor contains up and down position and over-travel limit switches which can be selectively adjusted for each particular installation and also for maintenance. It also may contain an absolute encoder, for example, a rotary or shaft encoder, for setting the fly set variable position travel stops and speed control.

A feature of the invention is that the winch construction is confined within a right quadrangular volume defined by the enclosure sides and straight prolonged extensions of the sides with the result that plural winches can be mounted side-by-side without fear of winch component interference.

A further feature is that mounting of the sheave assembly to and outside of the enclosure allows construction of a structurally sound enclosure that will protect the winch components while allowing full access to maintainable winch parts, including removal and replacement of the cables without removing the winch unit from its tubular enclosure.

The various features of novelty, which characterize the invention, are pointed out with particularity in the claims annexed to and forming a part of this application. For a better understanding of the invention, its operating advantages and specific objects attained by its use, reference should be had to the accompanying drawings and descriptive matter in which there are illustrated and described the preferred embodiments of the invention, and in which like reference numerals denote the same or similar components.

DETAILED DESCRIPTION OF PREFERRED EMBODIMENTS

Figure 1:
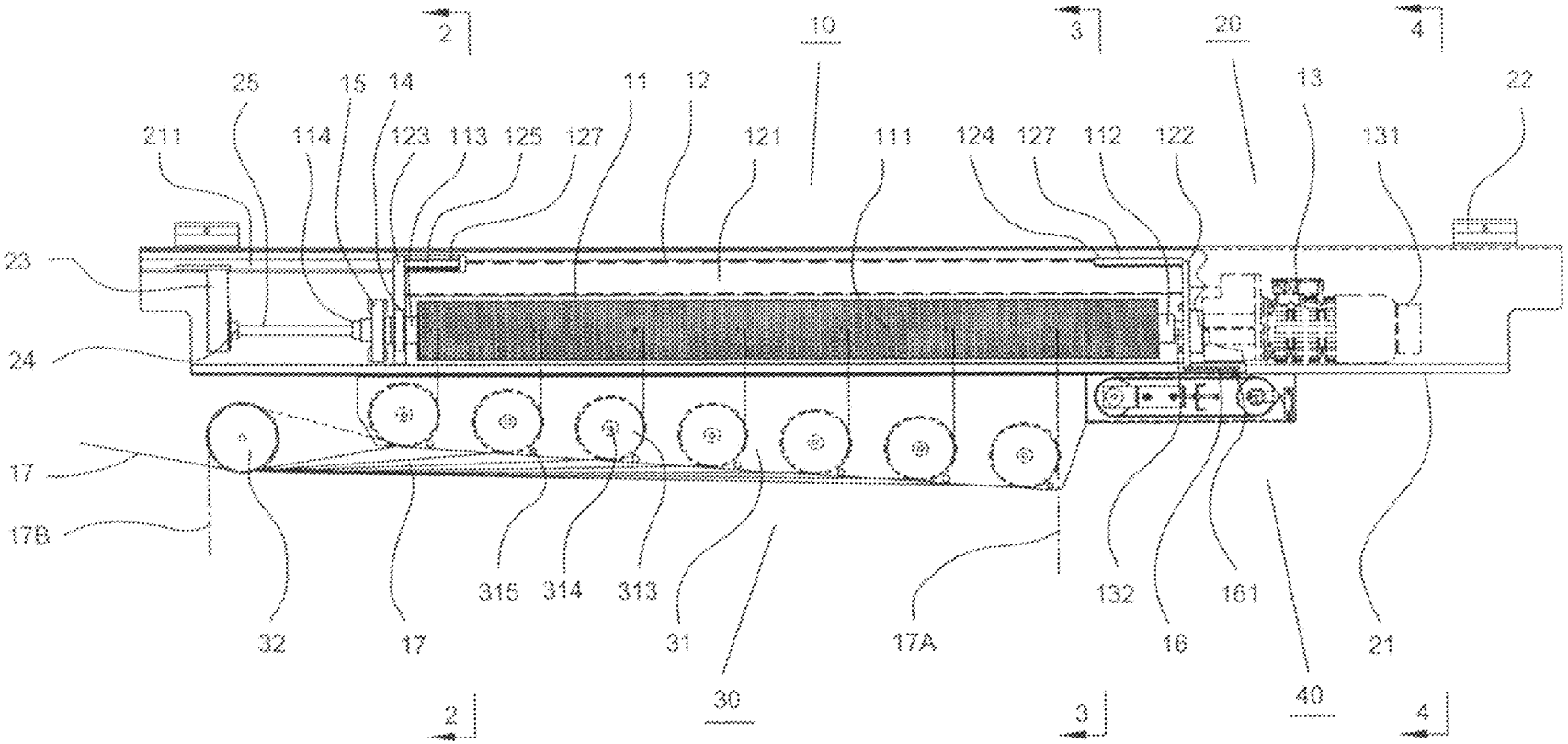
FIG. 1 is a side view of an improved winch in accordance with the invention shown in one configuration with the improved winch ready for mounting to a facility structure. The tubular support enclosure is partially cut to show the winch unit inside.

As used in this application, a "fly set" typically is the combination of a batten, loft blocks (sheaves) and one or more support lines, for example, a wire cable or rope, attached to the batten and engaging a loft block. Typically, the number of loft blocks equals the number of support lines. A "batten" is the structural member typically supporting a scenic element. Typically the batten is a steel or aluminum pipe, though other strip-type structural members can be substituted. When the scenery to be raised and lowered is, for example, a screen or backdrop extending laterally across the stage, the supporting batten typically has a length exceeding the width of the proscenium, i.e., the stage opening visible to the audience, and the batten would typically use 4-7 support lines spaced evenly across its top. As used herein, the terms "laterally: and "width" refer to the horizontal dimension or direction of the proscenium, and the term "vertically" refers to the vertical dimension or direction of the proscenium. The "stage ceiling" is the ceiling of the stage tower that is above and behind the open curtain and not visible to the audience. It typically extends, when the scenery is lifted straight up and removed from the view of the audience, to a distance above the top of the proscenium equal to or greater than the height of the scenery. The term "gridiron" refers to a rigid structural member typically composed of steel beams that forms an open grid structure extending parallel to and typically 6-7 feet below the stage ceiling out of view of the audience and which is capable of supporting various objects. "Wells" in the gridiron are larger openings through which support cables can be extended to battens or other structures beneath.

In a preferred embodiment, the invention is directed to an improved winch for raising and lowering objects, such as theatre scenery, consisting of a winch unit mounted inside and supported by a tubular support enclosure. The winch unit incorporates functions for lifting, lowering and supporting the objects, for emergency braking, for translating the drum in its longitudinal direction in synchronization with winding and unwinding the cables from the drum so that the orientation of the cables is maintained in relation to the tubular support enclosure. The winch unit may also be used for driving the limit switches and an encoder for sensing and controlling object position. The tubular support enclosure supports the winch unit and the cable guiding sheaves. It may also be used for mounting limit switches, encoder, and electrical controls. By "tubular support enclosure" is meant an integral tubular unit comprising side, bottom and top panels enclosing preferably at least 60% of the winch unit. The remaining 40% includes openings, which may be covered by removable panels for accessing the winch unit for maintenance and repair.

One form of the improved winch according to the invention is shown in FIG. 1 and FIGS. 2, 3, 4. The important feature of this invention is that the winch unit 10 is mounted inside a tubular support enclosure 21, fixed to the facility, which tubular support enclosure 21 supports and guides the winch unit 10 while providing access to movable components of the winch unit for maintenance and repair. In the preferred embodiment a sheave assembly 30 and a sensor unit 40 are mounted on the bottom side of the tubular support enclosure 21.

Figure 2:
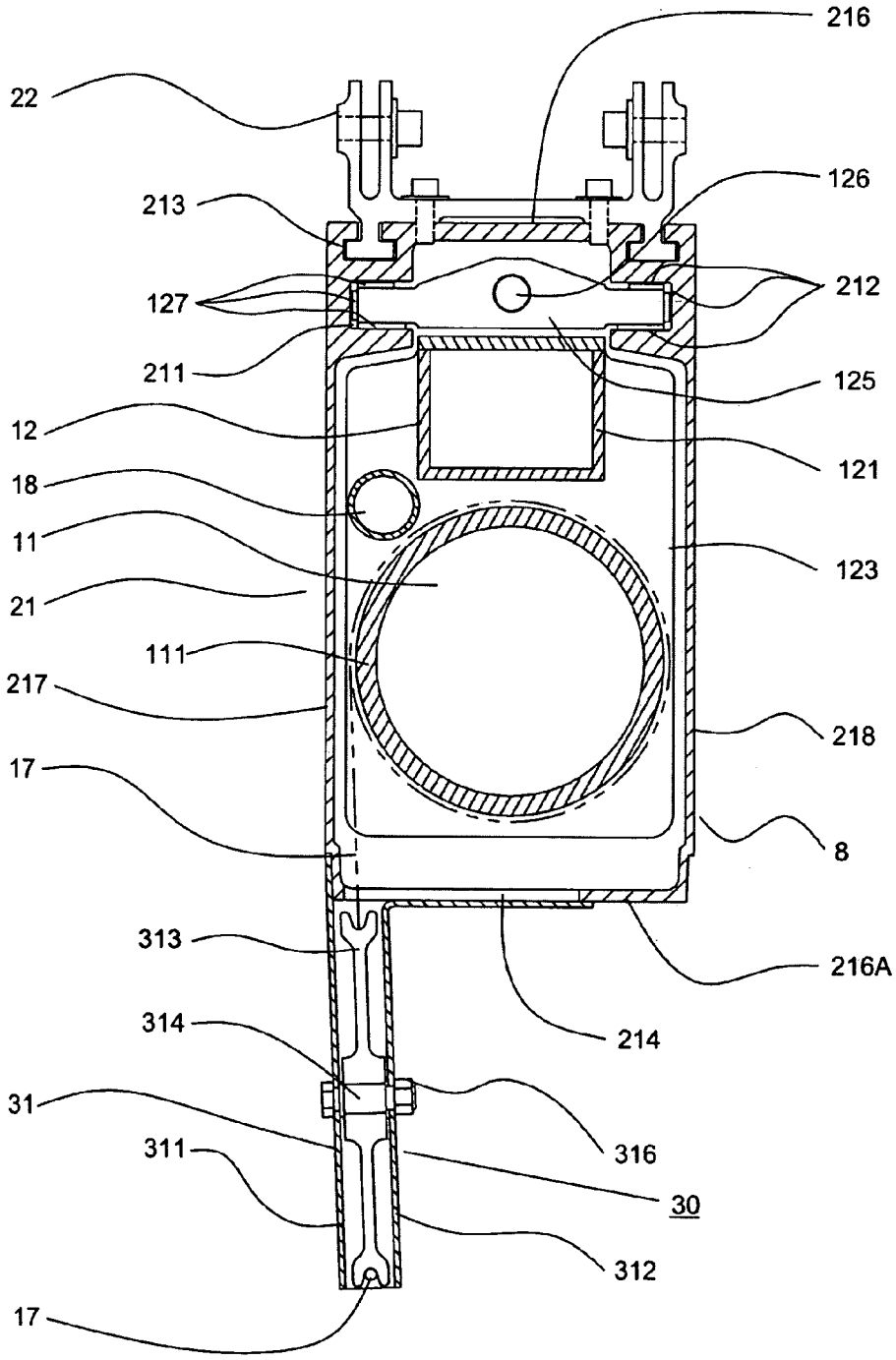
FIG. 2 is a cross sectional view of the improved winch taken along line 2-2 of FIG. 1, illustrating the brake end support, one arrangement of sheaves and sheave housing and tubular support enclosure geometry.

The form of winch unit 10 shown on FIG. 1 and FIG. 2 includes a drum assembly 11, rotatably supported and directly driven at one end through a motorized gear reducer 13 mounted on a motor end member 122, part of a frame 12, all translatable along the longitudinal axis of drum assembly 11 inside the tubular support enclosure. The opposite end of cable drum assembly 11 is supported from a bearing 14 through an elongated hub 113, part of, or bolted to the cable drum grooved portion 111 brake end. The bearing 14 can be mounted into a frame 12 brake end member 123. The elongated hub 113 includes means for connecting it to an over-speed brake 15, which would engage in case of over-speed drum rotation, if caused by the motorized gear reducer 13 or a motor brake 131 failure. Under normal conditions, the load on winch unit 10 is held by the motor or the motor brake 131, which are parts of the motorized gear reducer 13.

Figure 3:
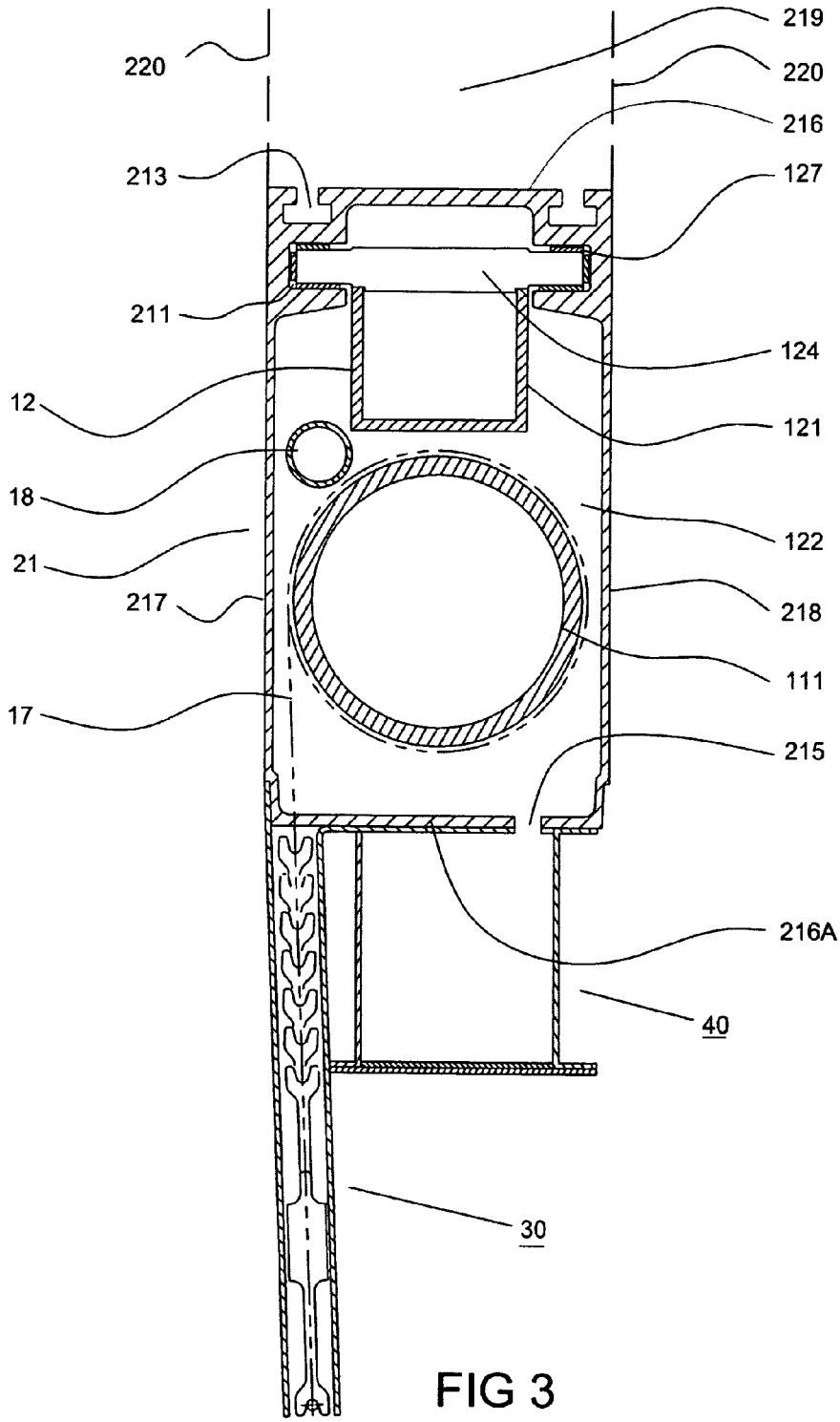
FIG. 3 is a cross sectional view of the improved winch taken along line 3-3 of FIG. 1, illustrating the motor end support, one arrangement of sheave and sheave housing, mounting of the sensor assembly and tubular support enclosure geometry.
Figure 4:
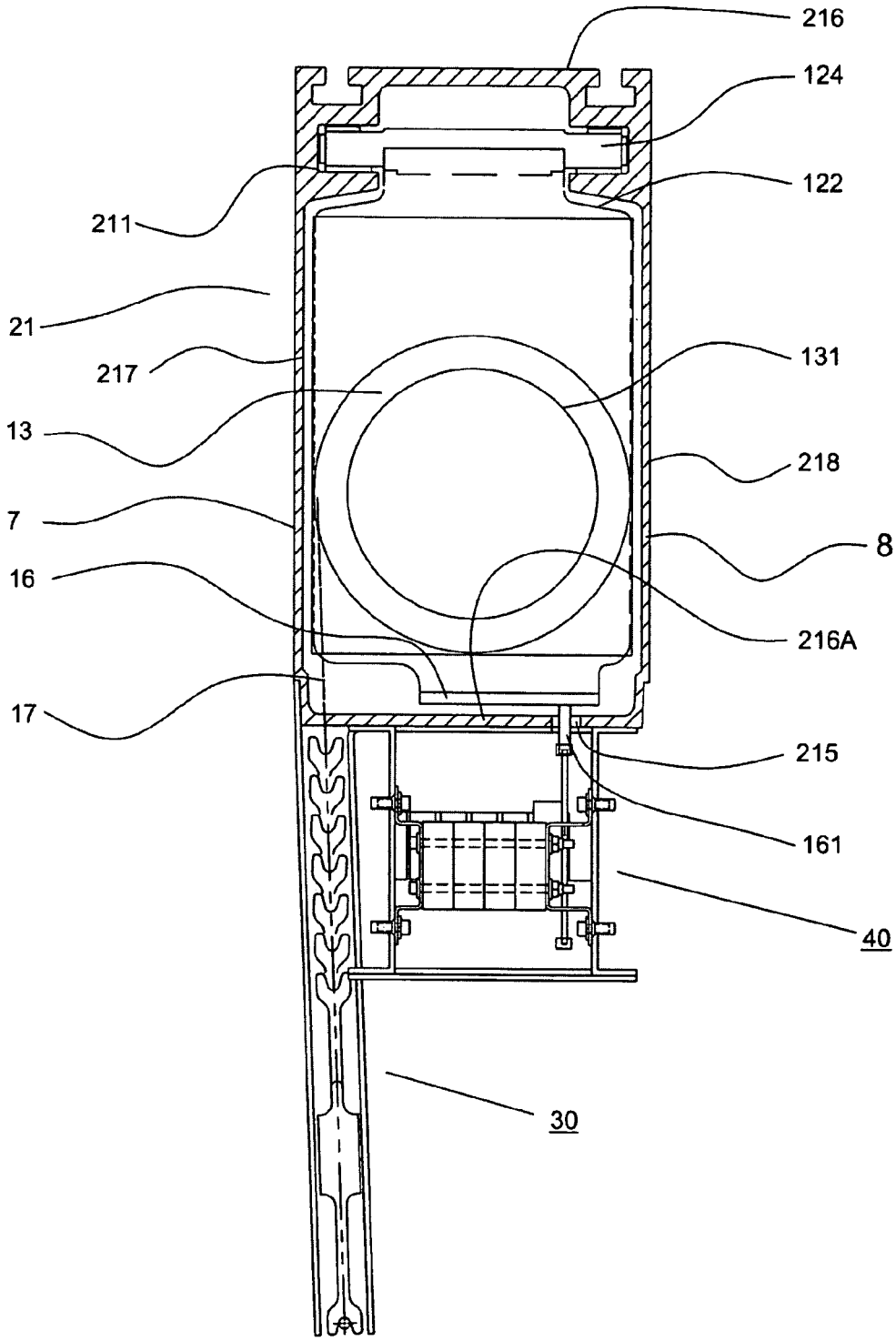
FIG. 4 is an end view of the improved winch taken at line 4-4 of FIG. 1 illustrating one type of mounting bracket for mounting the improved winch to the facility structure, one arrangement of sheaves and sheave housing, mounting of the sensor assembly, motorized gear reducer and support enclosure geometry.

In the preferred embodiment the winch unit 10 is mounted into the tubular support enclosure 21 so that it can be moved back and forth parallel to the longitudinal axis of the drum assembly 11, relative to the tubular support enclosure 21, and, as shown on FIG. 2, supported inside the tubular support enclosure 21 by support and guide recessed sections such as guide grooves 211 through sliding bearings 127 fastened to the motor end support 124 and to the brake end support 125 of the frame 12. Single or plural cables 17 pass from the drum grooved portion 111 over their respective vertically and/or horizontally offset cable-guiding sheaves 313, over respective loft blocks 56 (as shown on FIGS. 13, 14, 15, 16) to a pipe batten 57 used for supporting the stage sets. For some installations, when required due to the facility layout and geometry, the cables 17 can be further directed over or below a guide block 32 fastened to the tubular support enclosure 21. In the configuration shown on FIG. 1 and FIG. 2, the tubular support enclosure 21 is mounted to the facility structure (not shown) by means of brackets 22. In FIG. 3, the preferred tubular enclosure is rectangular with side panels or walls 217 and 218 and bottom panel or wall 216 below, which extends the sheave assembly. Looking again at FIG. 1, when the rotating drum assembly 11 winds or unwinds the cables 17, the cables travel back and forth in the drum grooved portion 111 grooves. Therefore, in order to provide straight cable runs between the drum grooved portion 111 and horizontally fixed cable guiding sheaves 313, the winch unit 10 has to travel laterally (parallel to the drums axis) in synchronization with and in the same direction as the cable back and forth travel in the drum grooved portion 111 grooves. By a "straight cable run" is meant that the angular orientation between the drum grooved portion 111 and the cable guiding sheaves 313 in maintained in a vertical orientation when the improved winch system is mounted horizontally, and when the improved winch system is mounted vertically, the cables are maintained in a horizontal orientation. If the winch system is mounted at an angle, then the cable angular orientation is maintained to maintain a straight cable run.

In the configuration shown in FIG. 1, the drum assembly 11 is used for horizontally moving the winch unit 10 inside the tubular support enclosure 21 in relation to the fixed cable guiding sheaves 313. The movement is fixed in synchronization with the cable 17 back and forth travel in the drum grooved portion 111 grooves. This is accomplished, in accordance with a preferred embodiment, by a power transmission screw 25 (ACME, ball or roller type), connected non-rotatably through a connector 24 to screw 25 support 23, inside the tubular support enclosure 21. A power transmission nut 114 (ACME, ball or roller type) is mounted to the drum assembly 11 brake end hub 113, which hub is hollow so that the power transmission screw 25 can pass, via the hollow hub, inside the drum assembly 11, which is also hollow, where the screw 25 is protected when the pipe batten hung from winch unit 10 is in up, or storage, position. The view of FIG. 1 with the power transmission screw 25 extending outside the drum assembly 11 occurs when the pipe batten is at down position. Storing the power transmission screw 25 inside the drum assembly 11 is possible because the drum is not mounted on a separate shaft, but the drum itself forms its own shaft. The power transmission nut 114, being secured to the hub 113, rotates together with the drum assembly 11 and also with respect to screw 25. The pitch of the screw 25 thread is equal to the pitch of the drum grooved portion 111 cable grooves. Therefore, the winch unit 10 is moved in synchronization with the back and forth travels of the cables 17 in the drum grooved portion 111 grooves. Straight cable runs/paths are maintained between the winch unit 10 and the cable guiding sheaves 313.

Another option is to mount the power transmission screw 25 rigidly to the end of the drum assembly 11 and to mount the power transmission nut 114 rigidly to the screw support 23. Now the power transmission screw 25 would rotate together with drum assembly 11, engage the fixed power transmission nut 114 and translate the drum assembly 11 together with the frame 12 and all the components mounted to the frame 12 relative to the tubular enclosure 21 in synchronization with the back and forth travel of cables 17 in drum assembly 11 grooved portion 111 grooves.

Looking at FIG. 1, the drum assembly 11 can be constructed of a cylindrical tubular member having the grooves 111 machined in its outer surface, with hubs 112 and 113 at each end. The hubs can be bolted or welded to the grooved drum grooved portion 111. Suitable materials for the cable drum grooved portion 111 are aluminum and steel. Other materials or their combinations can be used. For example, the drum grooved portion 111 can be made of one un-grooved tubular member with short pre-grooved cylindrical portions installed around and supported by the un-grooved tubular member. Likewise the drum grooved portion 111 can be made of short cylindrical grooved portions, held together by post-tensioned ties or by similar means.

In the embodiment shown in FIG. 1 the drum assembly 11 is mounted into the drum support frame 12, which comprises of one rigid horizontal member 121, motor end vertical member 122, brake end vertical member 123, motor end support 124 and brake end support 125. The motor end vertical member 122 can be made of steel or aluminum plates or castings, incorporating all mounting interfaces for the motorized gear reducer 13. The brake end vertical member can be made of steel or aluminum plates or castings, incorporating all mounting interfaces for the anti-friction bearing 14, over-speed brake 15 and, as shown on FIG. 2, shaft 126. The horizontal member 121 can be made of steel or aluminum tubing.

A protective device 18 shown on FIG. 2 is a roller assembly. On FIG. 6 the protective device 18A is configured as a curved cover. Protective devices can be mounted on the frame 12 for preventing and/or sensing the cables 17 from jumping the drum grooved portion 111 grooves. The protective devices 18 or 18A can have electricity conductive surfaces (not shown) normally insulated from the frame 12. Should a cable 17 develop slack or cross the drum grooved portion 111 groove, the cable will touch these conductive surfaces and ground these surfaces to the frame 12. A ground fault detector, part of electrical controls, would then stop the winch 10 operation. Another type of protective device can be a wire (not shown), tensioned close to the outside diameter of the drum or rollers supported by a wire or a rod (not shown) mounted close to the outside diameter of the cables 17 wound on drum grooved portion 111 between the frame 12 end members 122 at motor end and 123 at the brake end. This wire can also be insulated from the frame 12 and act as a ground fault detector as described above.

As shown on FIG. 1 and FIG. 3 the motor end support 124 is a rigid part of frame 12, connected to the top member 121 and motor end member 122. Bearings 127 are mounted on the motor end support 124 surfaces interfacing with the tubular support enclosure 21 guide surfaces 212.

As shown on FIG. 1 and FIG. 2 the brake end support 125 is mounted to the frame 12 through shaft 126. This permits the brake end support 125 to pivot about the longitudinal axis of shaft 126 and frame 12 so as compensate for possible tubular support enclosure 21 guide surfaces 212 and support and guide groove 211 irregularities. Bearings 127 are mounted on the brake end support 125 interfacing with the support and guide surfaces 212 of the tubular support enclosure 21.

One important feature of the above arrangement of the supports 124 and 125 is that all the forces caused by the drive torque from the motorized gear reducer 13 are resisted by the motor end support 124 while the brake end support 125 supports the vertical and lateral forces only. Likewise, if the over-speed brake 15 engages, its torque is applied to the brake end member 123 and transferred through the top member 121 to the motor end support 124, which will resist the forces applied by the over-speed brake 15 torque.

The over-speed brake 15 can be centrifugal type used in other fly system winches. It can be also solenoid-applied type or spring applied electrically released brake similar to what is used in the industry for motors and other rotating devices.

Looking at FIG. 1, FIG. 2, and FIG. 3, another option for the frame (not shown) is to eliminate the top axial-extending beam-like member 121. The tie between the vertical motor end member 122 and brake end member 123 would then be formed by the drum assembly 11. In this case the motor end vertical member 122 and the motor end support 124 have to be rigid to resist all the drive torques from the motorized gear reducer 13 and in addition the frictional forces between the bearings 127 and the tubular support enclosure 21 support and guide surfaces 212. Likewise the brake end vertical member 125 and the brake end support 123 have to be rigid, similar to the motor end support, in order to resist the braking torque from the over-speed brake 15 and in addition, the frictional forces between the bearings 127 and the tubular support enclosure 21 support and guide surfaces 212.

In the configuration shown on FIG. 1 and FIG. 2 the bearings 127 are used as sliding bearings between the winch unit 10 and tubular support enclosure 20. These bearings can be made of PTFE or PTFE compounds. The bearings 127 can be glued or mechanically fastened to the motor end support 124 and to the brake end support 125. As an alternate (not shown) anti-friction ball or roller bearings or cam followers can be used instead of the sliding bearings.

A feature of this invention is combining the winch unit 10 supports, its guides and its protective enclosure into a tubular support enclosure 21 which also has connection means 213 (mounting bracket recessed sections such as grooves) for adjustably positioning the mounting brackets 22 with complementary-shaped T-shaped extensions to the tubular support enclosure 21 as illustrated on FIG. 1, FIG. 2 and FIG. 3. The tubular support enclosure 21, together with mounting brackets 22 forms the winch support 20, ready for installation to a facility. These grooves 213 by which the tubular enclosure is supported allow slidable adjustment of the bracket 22 spacing to suit the spacing of the facility beams to which the brackets will be fixed. Once the properly spaced brackets are secured to the facility, locking screws can be tightened to fix the tubular enclosure to the brackets.

Figure 7:
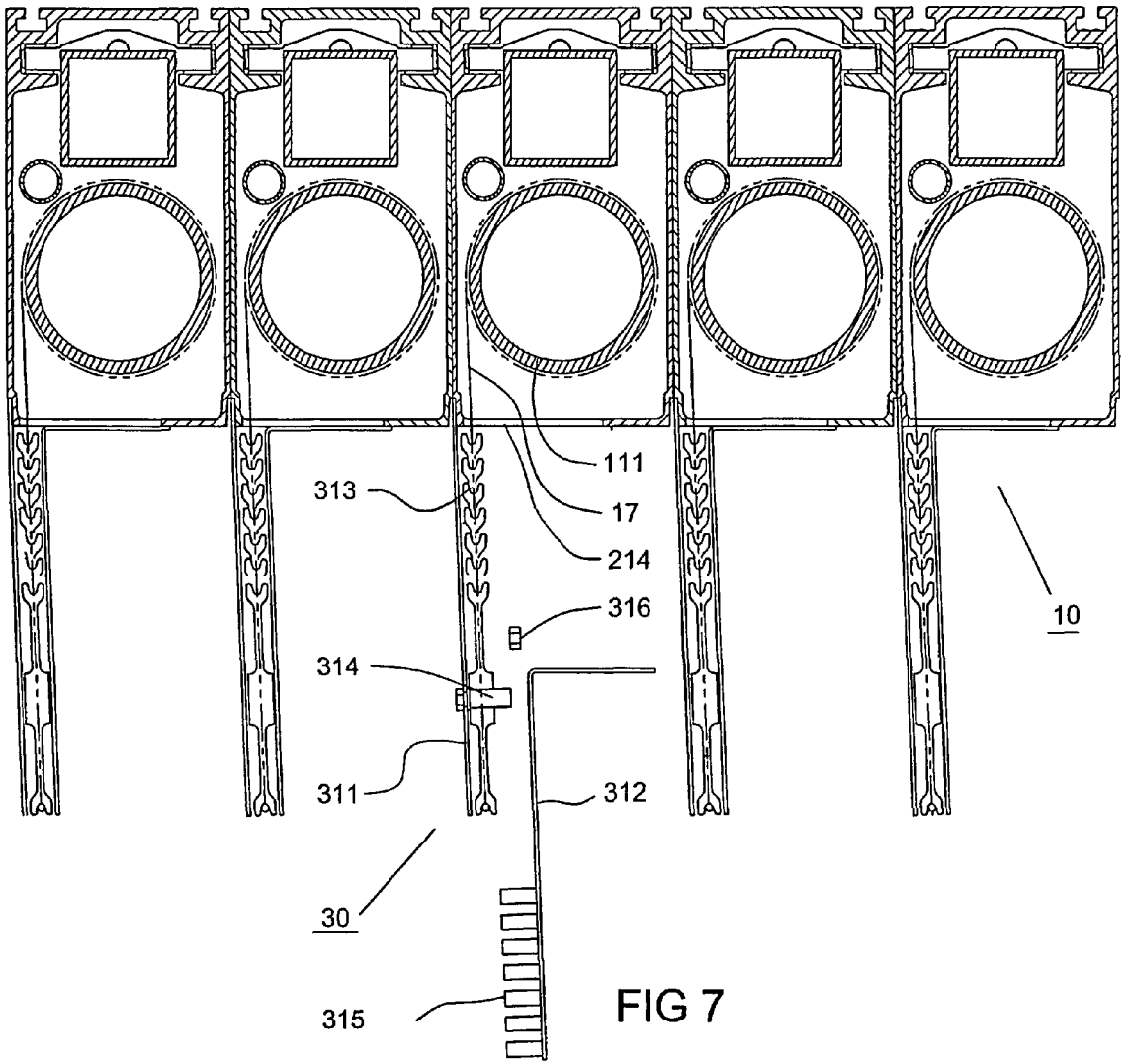
FIG. 7 is a cross sectional view showing several of the improved winches mounted side by side to a facility structure.

This invention as shown in FIG. 7 permits installation of the winches very close to each other (8 inches on centers), which is a standard spacing of the theater fly sets, without danger of interference between their adjacent moving parts and, as later described, it also provides access to all important winch unit 10 moving parts, including to the sensors for positioning and speed control, which may require service or replacement. It further permits removal and replacement of cables 17 without the need for removal of winch 10 from its mounts in the facility. This non-interfering close spacing is achieved by confining all winch components within a right quadrangular volume 219 defined by the enclosure side panels or walls left 217, right 218 and straight prolonged extensions of the sides, illustrated by the dashed line extensions 220 (FIG. 3). Note that no winch components lie outside that volume 219, and thus when the enclosures are mounted side-by-side (FIG. 7), no interference during operation will occur.

No other currently manufactured multi-cable winches permit such close spacing and in order to place the fly sets of 8-inch centers, these winches have to be installed in multiple rows or at different levels.

One problem in meeting this objective under the constraints are the drum diameters required by standards and codes, which, together with ¼ inch cable wrapped around it, would be approximately 7 inches. The second problem is that the standardized motor frame and gear reducer sizes which, for lifting about 2,500 pounds, would be approximately 7¼ inches wide. This invention makes it possible to mount all these winch elements inside a tubular support enclosure 21 that will resist vertical loads, longitudinal axial forces and torsion forces, with the outside dimension between the lines 220 on FIG. 3 not exceeding 8 inches.

Figure 6:
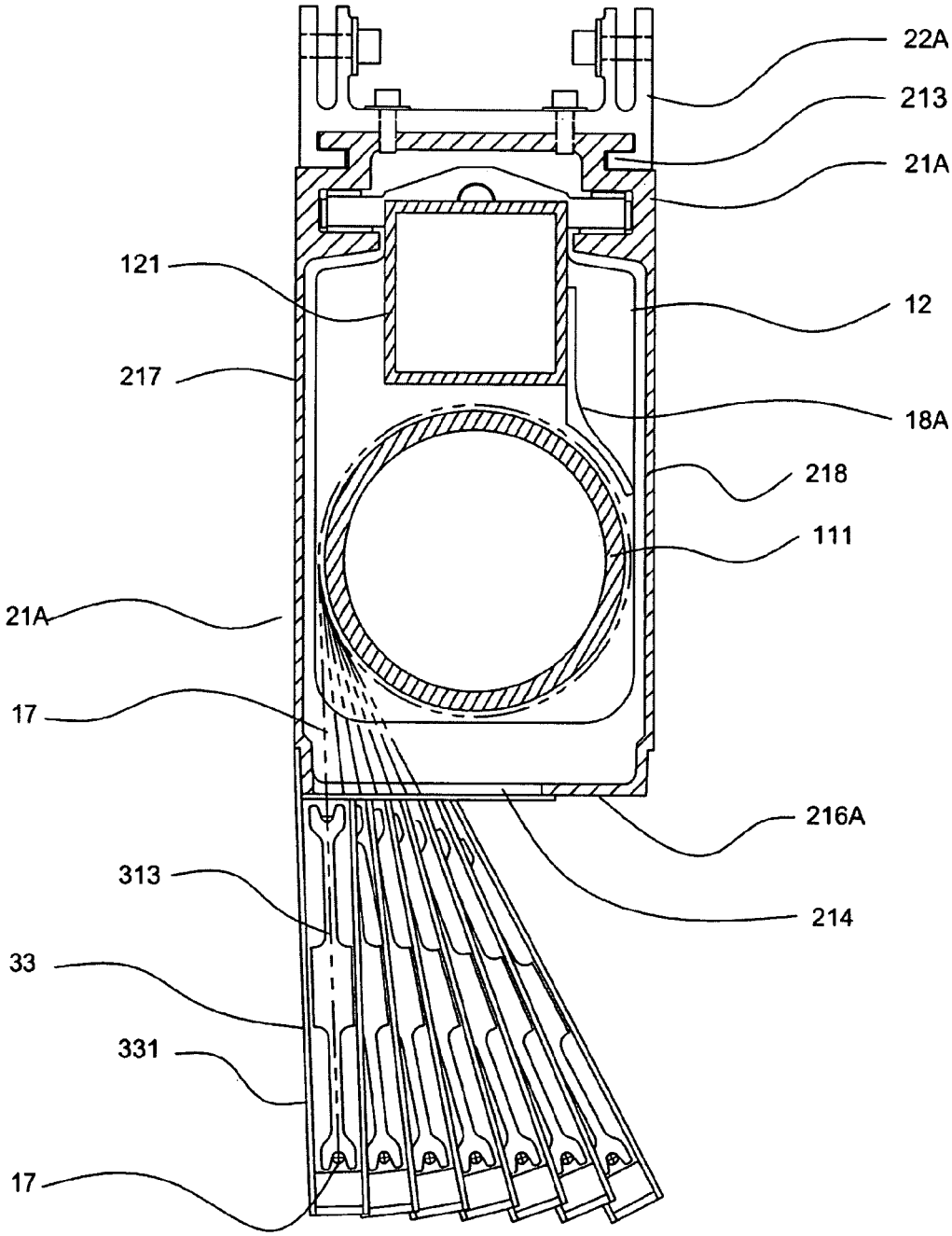
FIG. 6 is a cross sectional view of the improved winch taken along line 6-6 of FIG. 5 illustrating an alternate arrangement of sheaves, alternate mounting bracket and alternate support enclosure geometry.

Close mounting of the winches on 8-inch centers according to this feature of the invention is made possible by the cross-sectional profile of the tubular support enclosure 21, shown on FIG. 2 and FIG. 6. Referring now to FIG. 1, the tubular support enclosure 21 has to support vertical loads, as a beam applied on it through the brake end support 125 and the motor end support 124. It also has to support the longitudinal axial forces, applied by the cables 17 and by the power transmission screw 25. In addition, the tubular support enclosure 21 has to support torsion forces applied through the motor end support 124 to the support and guide grooves 211 as shown on FIG. 3. I have found that a thin walled tube is very efficient for supporting the torsion loads. This feature permits to use thin side walls for the tubular support enclosure 21, which in turn, provides maximum width inside the tubular support structure 21 for mounting the winch unit 10. The top and bottom walls and the portions around the support and guide grooves 211 of the tubular support enclosure 21 are made thicker to support the vertical forces in bending and to transfer the load concentrations from the motor end support 124 and brake end support 125 to the mounting brackets 22 without affecting the thin side walls below.

It should be noted that even if a winch unit 10 could be mounted inside a framed structure (not shown) and because a framed structure could not utilize thin side walls, an 8-inch winch side by side spacing would not be possible.

In the winch construction illustrated, the side walls can be as thin as ⅛-¼ inches, preferably 3/16 inches. This will accommodate the width of codes and standards compliant drum assembly 11 and motorized gear reducer 13, with adequate clearances. The height can be increased to accommodate thicker top 216 and bottom 216A walls if required for added strength. The resultant tubular support enclosure, even with the openings provided for access, will house the kind of winch unit described, provide a maximum overall enclosure width of 8 inches and will adequately resist the various stresses exerted during operation of the winch. Loads about 2500 lbs can be lifted with a motorized gear reducer 13 that fits into the 8 inch wide tubular support enclosure 21. Aluminum extrusions, with cross sectional profiles as shown as item 8 on FIG. 4 will provide sufficient strength for such an enclosure.

In the preferred embodiment, referring to FIG. 1 and FIG. 2 the tubular support enclosure 21 is a substantially rectangular aluminum extrusion configured to form the support and guide grooves 211 together with bottom, side and top support and guide surfaces 212 for mounting the winch unit 10 into the tubular support enclosure 21 so that it can be moved back and forth during operation parallel to the longitudinal axis of the drum assembly 11. The grooves 213 for the mounting brackets 22, used for installation of winch 10 into the facility, can also be part of the tubular support enclosure 21. These grooves 213 can be inverted T shape as shown on FIG. 2 or horizontal as shown on FIG. 6. While the preferred embodiment describes an extruded aluminum tubular support enclosure 21, the tubular support enclosure with the support and guide grooves 211 can also be constructed of independent components (not shown), made of aluminum or other materials, welded and/or bolted together.

FIGS. 2, and 6 show access openings 214 cut on the bottom side of tubular support enclosure 21 for cables 17 passing from drum grooved portion 111 to the cable guiding sheaves 313. These openings can also be used for removal and installation of cables 17 to drum grooved portion 111. A slot 215, shown on FIG. 3 and FIG. 4, can be also cut on the bottom side of the tubular support enclosure 21 for connecting the sensor assembly 40 to the movable frame 12 through a sensor connecting pin 161 fastened to the bracket 16 (FIG. 1). Additional holes (not shown) may be provided for mounting the sheave assembly 30, optional guide block 32 (FIG. 1), the sensor assembly 40 and the screw support 23 to the tubular support enclosure 21. The power transmission screw 25 is non-rotatably mounted to the screw support 23 through screw connector 24. The power transmission screw 25 engages the power transmission nut 114 part of the winch unit 10 drum assembly 11.

According to FIGS. 1, 2, 4, and 6 the tubular support enclosure 21 can be installed to the facility structure (not shown) through mounting brackets 22 and 22A. One type of mounting bracket 22 made from aluminum extrusion is shown on FIG. 1, and FIG. 2. The brackets 22 engage the recessed sections, preferably inverted T-shape grooves 213 in tubular support enclosure 21, and are inserted into these grooves. One bracket 22 can be bolted to the tubular support enclosure 21 in order to support the horizontal loads applied by the cables 17. Bolting would also eliminate the torsional movement of the tubular support enclosure 21 that may be caused by the torsion applied to the tubular support enclosure 21 by the motorized gear reducer 13 if excessive tolerance gaps exist between the brackets 22 and the grooves 213.

The second mounting bracket 22 can be but does not have to be bolted to the tubular support enclosure 21. Without bolting the second bracket 22 engages the grooves 213 and supports the vertical loads. Its position can be easily adjusted in the tubular support enclosure 21 by sliding it in the grooves 213 in the longitudinal direction so as to compensate for the interfacing facility structure tolerances.

Figure 5:
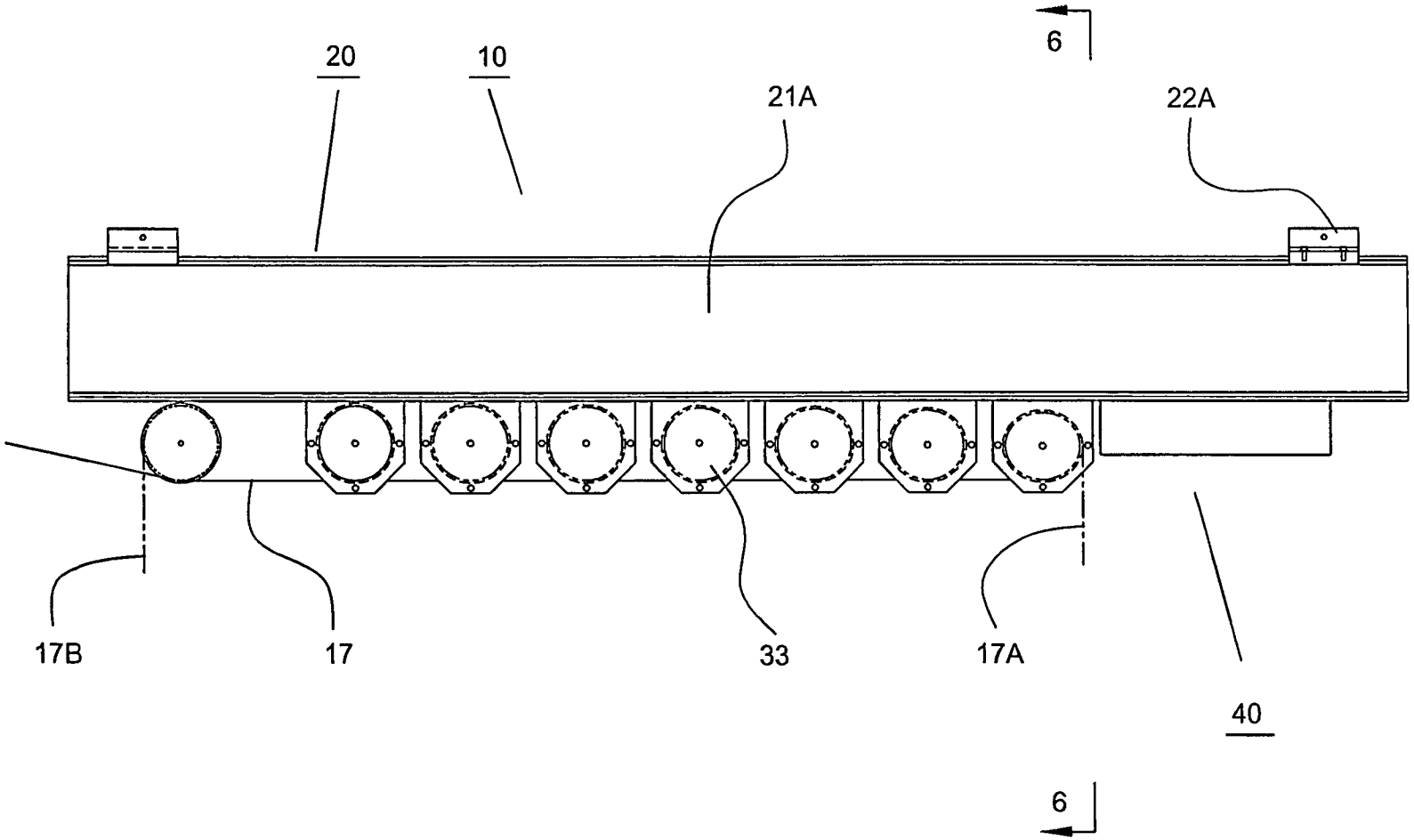
FIG. 5 is a side view of an improved winch in accordance with the invention, shown in another configuration, with the improved winch ready for mounting to a facility structure, showing alternate arrangement of sheaves and alternate mounting brackets.

The other type mounting bracket 22A, made of aluminum extrusion, is shown on FIG. 5 and FIG. 6. This bracket 22A engages the horizontal grooves at the sides and near the top of the tubular support enclosure 21A. Other than the geometry, its functionality is identical to the bracket described for FIGS. 1 and 2.

One configuration of the sheave assembly 30 is shown on FIG. 1 and FIG. 2. In this configuration the cable guiding sheaves 313 are mounted into a common enclosing housing 31 in vertically ascending fashion so as to provide vertical clearance between cables 17 leaving the cable guiding sheaves 313. The assembly 30 comprises of outer side plate 311, inner side plate 312, sheaves 313, sheave shafts 314 and cable guards 315. The outer side plate 311 and the inner side plate 312 are fastened to the bottom side of the tubular support enclosure 21. The outer side plate 311 may be permanently fastened to the tubular support enclosure 21 by riveting, welding or bolting. One important feature of this invention is that the inner side plate 312 is removable and when removed, as shown on FIG. 7, access is provided to the winch unit 10 drum grooved portion 111 through the access openings 214 in the bottom side of tubular support enclosure 21 for removal and replacement and connecting the cables 17 to drum grooved portion 111.

Looking again at FIG. 1 and FIG. 2, the cable guiding sheaves are mounted on shafts 314, which shafts are permanently connected to the outer side plate 311 and connected through removable nuts 316 to the inner side plate 312. This unique arrangement of the invention permits removal of the inner side plate 312 while the cable guiding sheaves 313 can remain in place supported by the outer side plate 311 only. This is an important feature for removal and installation of cables 17 to drum grooved portion 111.

The cable guards 315 are used to prevent the cables 17 from leaving the grooves of sheaves 313. The cable guards 315 may also be used to tie the sheave assembly 30 side plates 311 and 312 together for additional rigidity. They can also prevent a cable guiding sheave 313 from falling out of the sheave assembly 30 in case of the sheave shaft 314 failure. The cable guards 315 are bolted to the inner side plate 312 and to the outer side plate 311. When the inner side plate 312 is removed, the bolts can be disconnected from the outer side plate 311 only, so that the cable guards 315 are removed together with the inner ride plate 312. This permits access to the grooves of sheaves 313 for replacement of cables 17, which may have pre-installed fittings (not shown) that would not fit through the sheave 312 groove when the cable guard 315 is in place. This arrangement also permits the removal of a cable guard if a straight cable drop 17A is required as shown on FIG. 1. The side plates 311 and 312 can be made of aluminum or steel. Preferred material for the sheaves is nylon.

A second configuration of sheaves is shown on FIG. 5 and FIG. 6. This configuration consists of individual sheave assemblies 33 each mounted to the bottom side of tubular support enclosure 21A. Each sheave assembly 33 consists of housing 331 and sheave 313. As shown on FIG. 6, each sheave assembly 33 has a different angular orientation with respect to the bottom surface of tubular support enclosure 21A. This separates the cables 17 horizontally from each other. For removal and replacement each cable 17 the respective sheave assembly 33 has to be removed in order to provide access to drum grooved portion 111 through the opening 214. A sheave assembly 33 can also be removed if a straight cable 17A drop from drum grooved portion 111 is required as shown in FIG. 1.

Figure 1A:
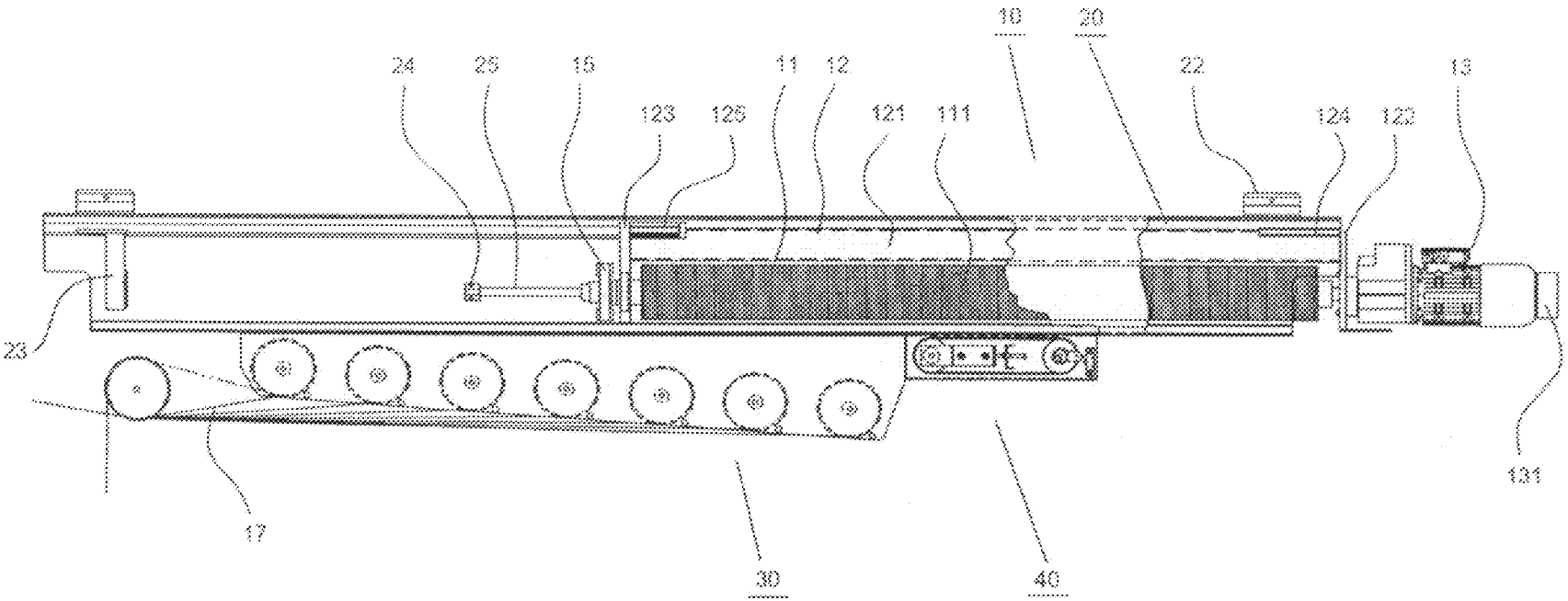
FIG. 1A is a side view of an improved winch, shown in FIG. 1, showing the motor and gear drive withdrawn from the enclosure for servicing without affecting the integrity of the enclosure mounting to the facility.
Figure 1B:
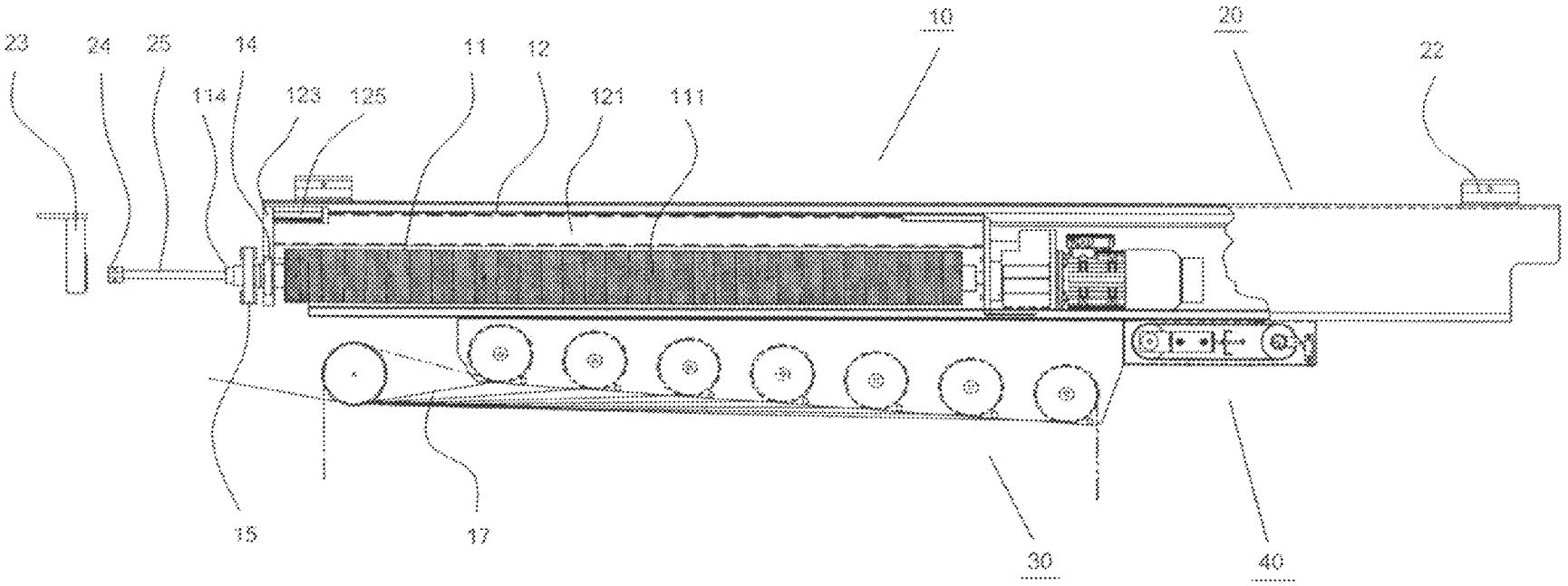
FIG. 1B is a side view of an improved winch, shown in FIG. 1, with the over-speed brake and bearing end of the winch unit withdrawn from the enclosure for servicing without affecting the integrity of the enclosure mounting to the facility

According to a feature of the invention (FIGS. 1, 1A, and FIG. 2) access for maintenance or removal and replacement of the motorized gear reducer 13 is provided by disconnecting the power transmission screw connector 24 from the support 23 at the left of FIG. 1 and sliding the winch unit 10 on bearings 127 to the right so that the motorized gear reducer is moved outside, and past the end of the tubular support enclosure 21, all while the motor end support 124 remains engaged and supported by the tubular support enclosure 21 support and guide grooves 211. For this purpose, the right end of the enclosure may be left open as shown or provided with a removable cover. According to FIG. 1B the access for maintenance or removal of the over-speed brake 15, bearing 14, power transmission nut 114, power transmission screw 25 and screw connector 24 is provided by disconnecting the screw connector 24 from the support 23, then by disconnecting and removal of the support 23 and by sliding the winch unit 10 to the left so that the over-speed brake 15 and the selected components are outside and past the brake end of the tubular support enclosure 21, again while the brake end support 125 remains engaged and supported by the tubular support enclosure support and guide grooves 211. Similarly, the left end of the enclosure may be left open as shown or provided with a removable cover.

Referring now to FIG. 7, the access for removal of the cables 17 from the drum grooved portion 111, and their replacement, is provided through the access openings 214 on the bottom side of tubular support enclosure 21 after removal of the sheave assembly inner side plate 312.

Figure 8:
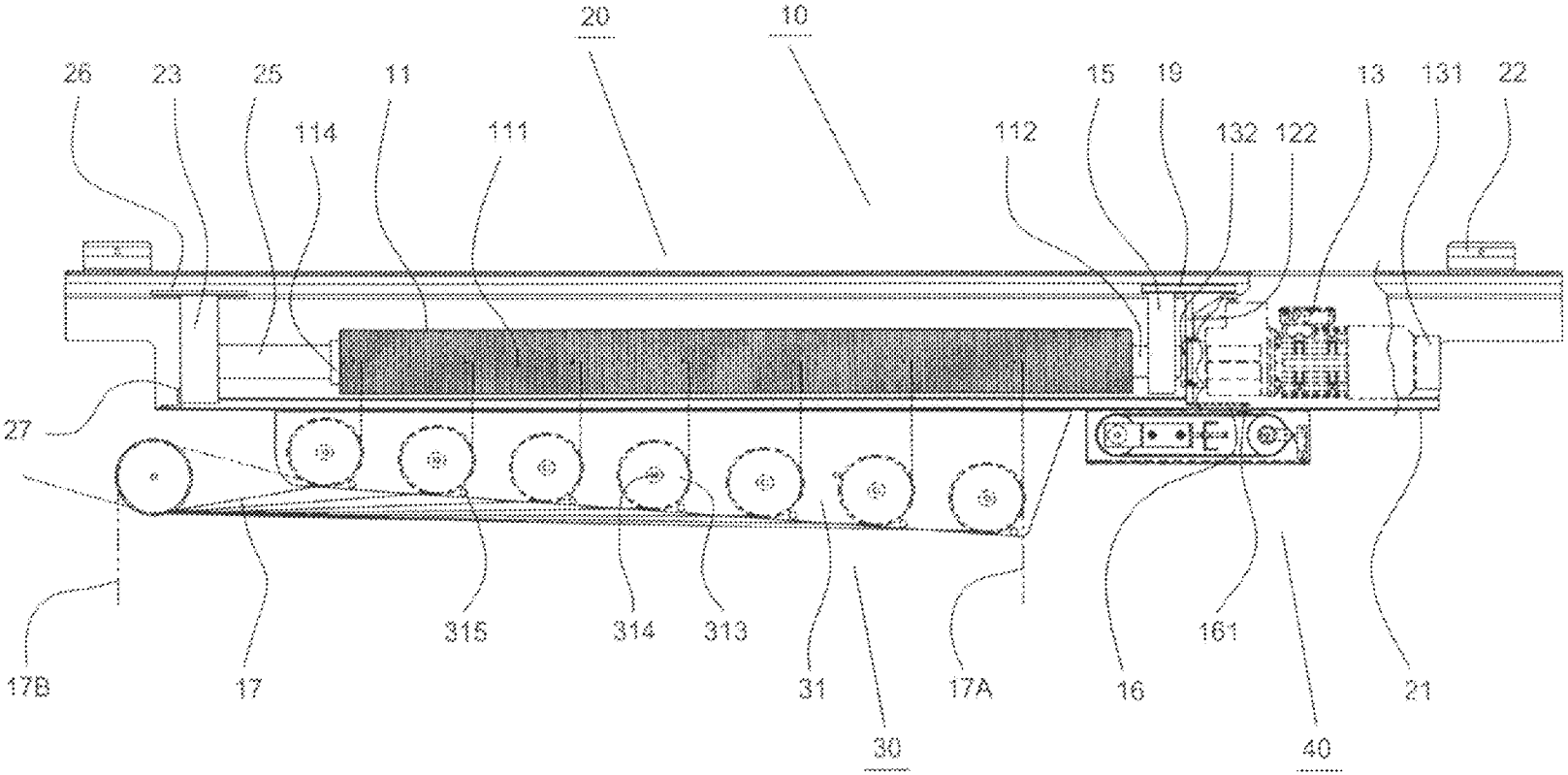
FIG. 8 is a side view of an improved winch in accordance with the invention shown in another configuration with the improved winch ready for mounting to a facility structure. The tubular support structure is partially cut to show the winch unit inside.

FIG. 8 illustrates another configuration of the improved winch. This winch 10 includes a drum assembly 11, rotatably supported and directly driven at its drive end through motorized gear reducer 13 mounted on a sliding or rolling base 19. The sliding or rolling base 19 consists of a motor end member 122 and sliding guide 124, rigidly connected to each other so as to slidably or rollably support the motorized gear reducer from the tubular support enclosure 21 by guide grooves 211 (FIG. 3) through sliding or rolling bearings (not shown) and transfer the motorized gear reducer 13 drive torque into the tubular support enclosure 21. The opposite end of a cable drum assembly 11 is supported from a power transmission screw 25 (ACME, ball or roller type), connected rigidly and non-rotatably to the screw support 23 inside the tubular support enclosure 21 so that all the forces imposed by the cable drum assembly 11 are transferred through the power transmission screw 25 and the screw support 23 into tubular support enclosure 21.

The drive end of the drum assembly 11 has an elongated hub 112 at its motor end. The motor end hub 112 engages the motorized gear reducer 13 shaft 132 that supports and rotates the drum assembly 11. An over-speed brake 15 is also mounted to the sliding or rolling base 19. The over-speed brake 15 engages the motor end hub 112 in case of motorized gear reducer 13 or the gear reducer shaft 132 failure. The over-speed brake 15 stops the rotation of drum assembly 11 and supports the lifted load hung from cables 17.

In the configuration shown in FIG. 8, the drum assembly 11 is used for horizontally moving the drum assembly 11 and motorized gear reducer 13 together with sliding or rolling base 19 inside the tubular support enclosure 21 in relation to the cable guiding sheaves 313. The movement is fixed in synchronization with the cable 17 back and forth travel in the drum assembly 11 grooved portion 111 grooves. This is accomplished by a power transmission screw 25, which is connected non-rotatably to the screw support 23 inside the tubular support enclosure 21. A matching power transmission screw nut 114 is mounted to the drum assembly 11, which is hollow so that the drum assembly 11 can move over the power transmission screw 25 when the drum assembly 11 translates in its longitudinal direction when it rotates.

The nut 114 being secured to drum assembly 11 rotates together with the drum assembly 11 and also with respect to power transmission screw 25. The pitch of the power transmission screw 25 thread is equal to the pitch of the drum assembly 11 grooved portion 111 cable grooves. Therefore, the drum assembly 11, together with the sliding or rolling base 19 and motorized gear reducer 13 are moved in synchronization with the back and forth travels of cables 17 in drum assembly 11 grooved portion 111 grooves. Straight cable paths are maintained between the drum assembly 11 and cable guiding sheaves 313.

Another option is to mount the power transmission screw 25 rigidly to the end of the drum assembly 11 and to mount the power transmission nut 114 rigidly to the screw support 23. Now the power transmission screw 25 would rotate together with drum assembly, engage the fixed power transmission nut 114 and translate the drum assembly 11 together with the sliding base 19 in synchronization with the back and forth travel of cables 17 in drum assembly 11 grooved portion 111 grooves.

Other features of the configuration illustrated in FIG. 8 remain similar to those described for the preferred embodiment for FIG. 1 and in the figures referred to in FIG. 1.

Figure 8A:
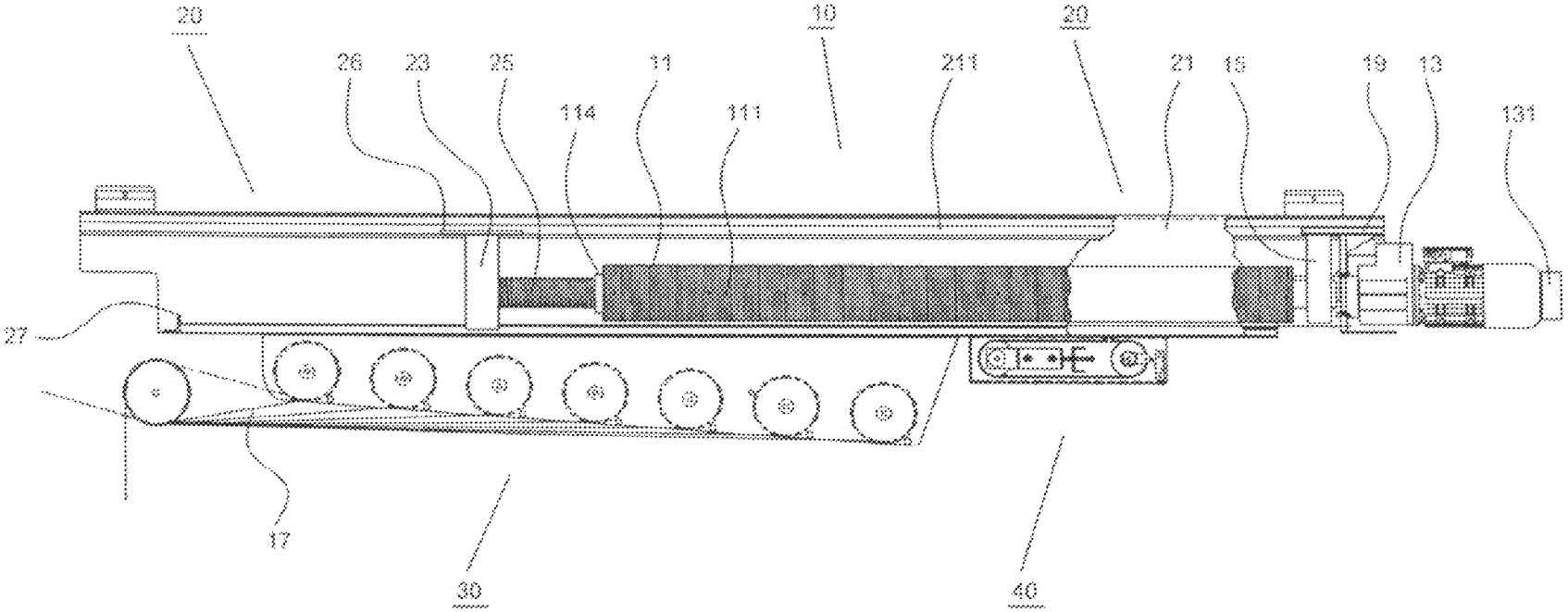
FIG. 8A is a side view of an improved winch, shown in FIG. 8, with the motorized gear reducer and over-speed brake exposed for maintenance. The tubular support enclosure is partially cut to show the winch unit inside.

According to FIG. 8A the access for maintenance or removal and replacement of the motorized gear reducer 13, over-speed brake 15 and other components mounted at or near the motorized gear reducer 13 is provided by disconnecting the support 23 top plate 26 from the tubular support enclosure 21 support and guide groove 211 and from the angle 27 (if used). The entire winch unit 10 can now be moved while supported by tubular support enclosure 21 guide and support grooves 211 to a position where all the motor end components are outside the tubular support enclosure 21 and accessible for maintenance.

Figure 9:
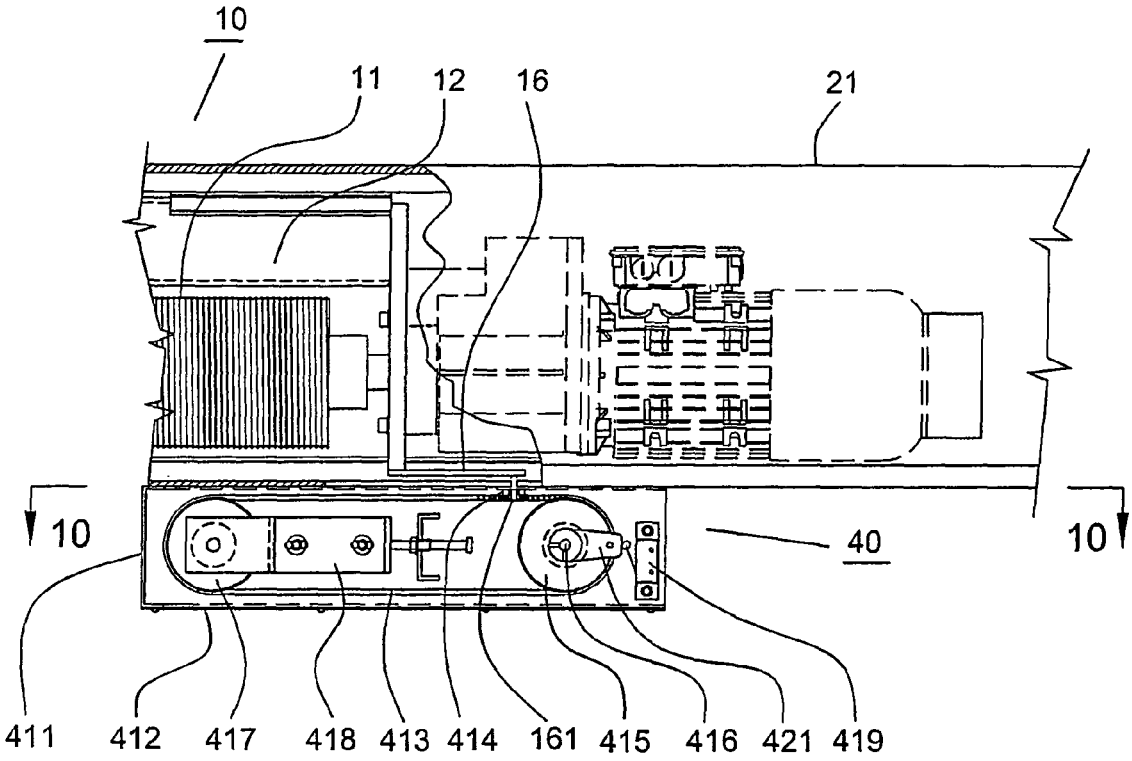
FIG. 9 is a partial cross section of the control sensor assembly and winch unit illustrating one configuration of control sensor and its connecting linkage to the winch unit.
Figure 10:
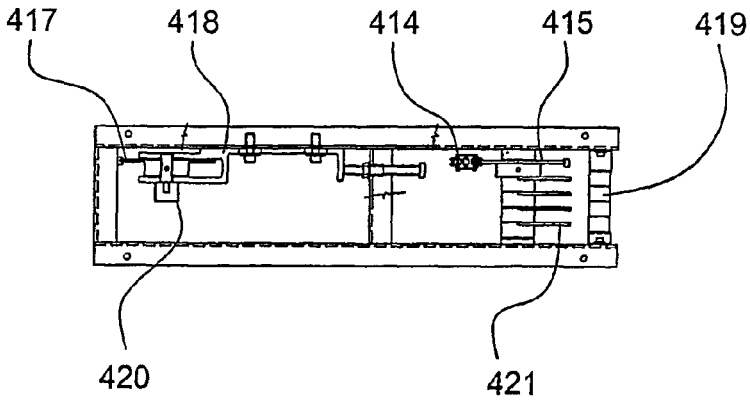
FIG. 10 is a cross sectional view of the control sensor assembly taken along line 10-10 of FIG. 9.

FIG. 9 and FIG. 10 illustrate one configuration of the control sensor assembly 40 in the enclosure 411 with cover 412, mounted on the bottom side of tubular support enclosure 21. The assembly consists of a roller chain, or timing belt, 413 forming a continuous loop around a drive sprocket 415 and a tensioning idler sprocket 417 through a chain connector 414. Sprocket 417 is mounted into the enclosure 411 through a mount 418, which permits sprocket 417 position adjustment as required for chain 413 tensioning. The chain connector is linked to the winch frame through a bracket 16, part of winch frame 12 and through a sensor connecting pin 161. The pin 161 can float vertically inside the chain connector 414 so as not to affect the sprocket 415 angular positioning when there is vertical movement between the pin 161 and chain connector 414.

The back and forth movement of the winch unit 10 as the cables wind and unwind will move the chain 413 through equal distance and rotate the sprocket 415 and 417. The diameter of sprocket 415 is selected so that it would rotate somewhat less than one turn during the maximum horizontal travel of the winch unit 10. Rotation of the sprocket 415 also rotates the shaft 416 together with the cams 421 and encoder 420. The cams 420 are mounted on shaft 416 through means to permit their individual rotational position adjustment with respect to the shaft 416 and with respect to each other so that their ridges or notches 422 would actuate their respective limit switches 419 at the required winch terminal travel positions. For a theater fly winch one limit switch is normally used for the up travel terminal position, one for up over-travel position, one for down terminal travel position and one for the down over-travel position. The stopping at all intermediate travel positions, which may be programmed as required for a particular performance, is controlled by the encoder 420 mounted on the bracket 418 and is also rotated by a shaft part of sprocket 417.

As seen from FIGS. 13, 14, 15, 16, showing the installation of the winches 10 into a theater facility, with the sheave assembly above or below the enclosure, the control sensor assembly 40 is always accessible for maintenance and adjustments. This is one major advantage of the configuration and mounting location of the control sensor assembly 40 described under FIG. 9 and FIG. 10. The other advantage is that a single turn absolute encoder 420 can be used which is less costly than multi-turn absolute encoders.

Looking at FIG. 1, the control sensors (not shown) could also be mounted inside the tubular support enclosure 21, on the brake end member 123 in the space above the power transmission screw 25. In this case, they would be driven by the rotation of hub 113 through a roller chain (not shown) and a roller chain sprocket (not shown) mounted on the sensors. Since the drum assembly 11 rotates approximately through 40 turns for full travel in a typical installation, an additional gear reducer (not shown) would be required for reducing the limit switch cams rotation to one turn.

Figure 11:
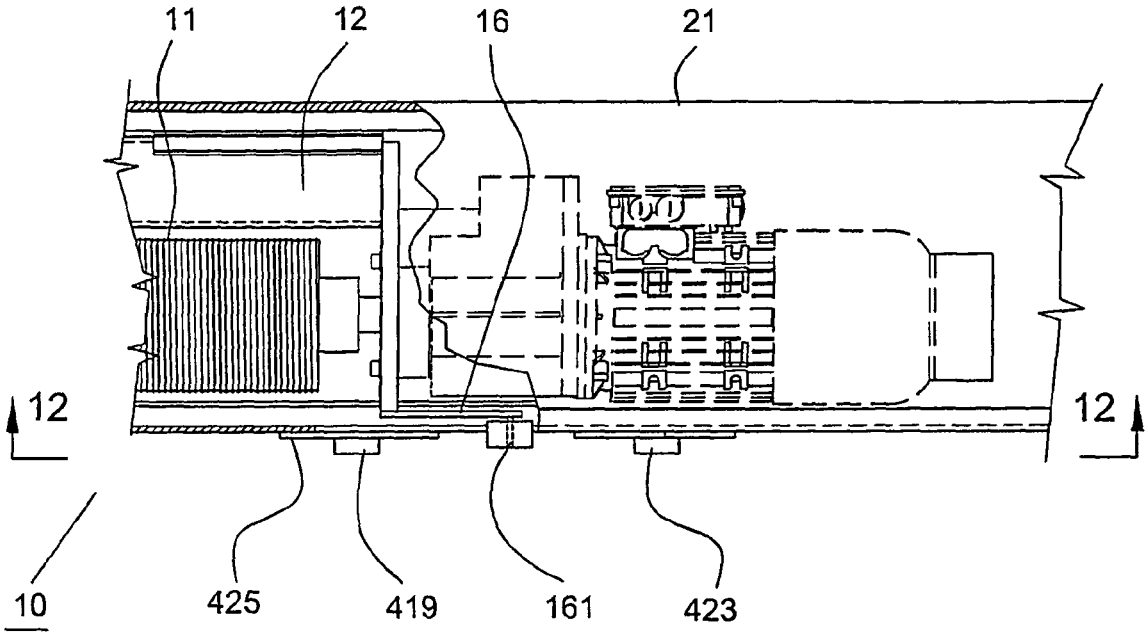
FIG. 11 is another partial cross sectional view of the control sensor arrangement and winch unit illustrating a configuration of limit switches directly activated by the winch unit back and forth movement through its control linkage.
Figure 12:
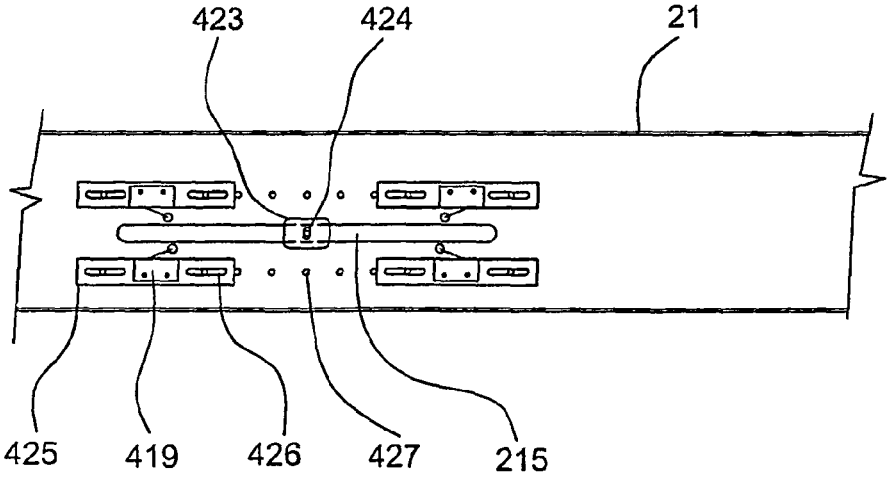
FIG. 12 is a cross sectional view of the limit switch mounting taken along line 12-12 of FIG. 11.

FIG. 11 and FIG. 12 illustrate another configuration of the limit switch mounting on the bottom side of tubular support enclosure 21. In this configuration a limit switch actuator slide 423 is mounted into the slot 215 cut through the bottom side of tubular support enclosure 21 and is guided by this slot. The limit switch actuator slide 423 is connected to the winch unit frame 12 through the bracket 16 and pin 161, which engages the hole 424 in the switch actuator slide 423. The hole 424 is slotted, perpendicular to the actuator slide 423 travel in the slot 215. This permits pin 161 vertical and lateral movement in the limit switch actuator slide 423 slotted hole 424 so that no vertical or lateral movements and forces are transferred from the pin 161 to the actuator slide 423 during the back and forth travel of the winch unit 10, which may slightly wobble during its back and forth travel due to the guide surfaces tolerance variations. The limit switches 419 are mounted near the ends of the limit switch actuator slide 423 travel to stop the winch at the up and down terminal positions and at the up and down over-travel positions when the limit switch actuator slide 423 strikes the limit switch 419 actuator arm. The limit switches 419 are mounted on sliding bases 425, which have slotted holes 426 for their position adjustment. For assisting precise limit switch 419 position adjustment, additional means, such as precision screw adjustment (not shown) can be used. For major changes of up and down stopping positions, the limit switches 419 together with their sliceable bases 425 can be mounted into different holes 427 at the bottom of the tubular support enclosure 21.

FIG. 11 and FIG. 12 do not show the encoder mounting or its driving method. For this limit switch arrangement a string actuated encoder (not shown) can be used with the string pulled by winch unit 10. Looking at FIG. 1, another option would be to mount the encoder (not shown) inside the tubular support enclosure 21 in the space above the power transmission screw 25. The encoder would be driven by rotation of hub 113 through roller chain transmission (not shown), installed between the hub and a second sprocket mounted on the sensors (not shown).

Figure 13:
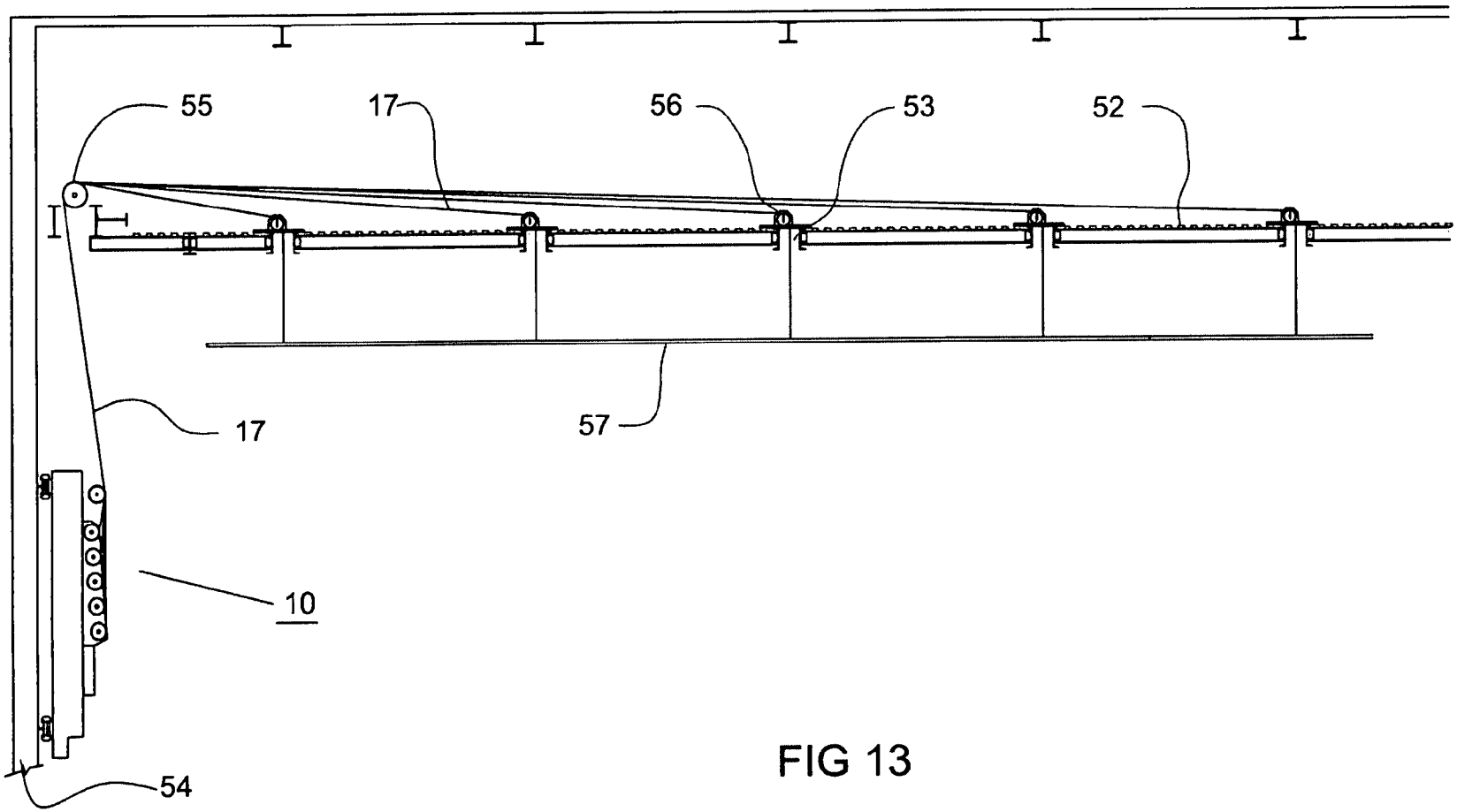
FIG. 13 is a side view of a stage, gridiron and fly set with the improved winch mounted on the stage sidewall.

FIG. 13 shows one installation in the facility where the improved winch 10 is installed on the stage sidewall 54 in vertical position. The cables 17 pass from the winch over the head block 55, over the loft blocks 56 and down to the pipe batten 57. This option of installation is particularly beneficial in existing theaters where the manually operated fly sets are replaced with motorized winches which, in this case, can be mounted on the wall that is used for the manual fly set counterweights and counterweight guides. Likewise, the existing head blocks 55 and loft blocks 56 will remain usable. Another reason why the improved winch 10 is particularly suitable for refurbishing the existing theaters in this manner is that winches 10 can be mounted adjacent to each other, as shown on FIG. 7 spaced at 8 inch centers, which is the generally accepted spacing for the motorized fly sets. The existing cables 17 can also be re-used, disconnected from the counterweights (not shown) and re-connected to the improved winch 10 cable drum assembly 11.

Figure 14:
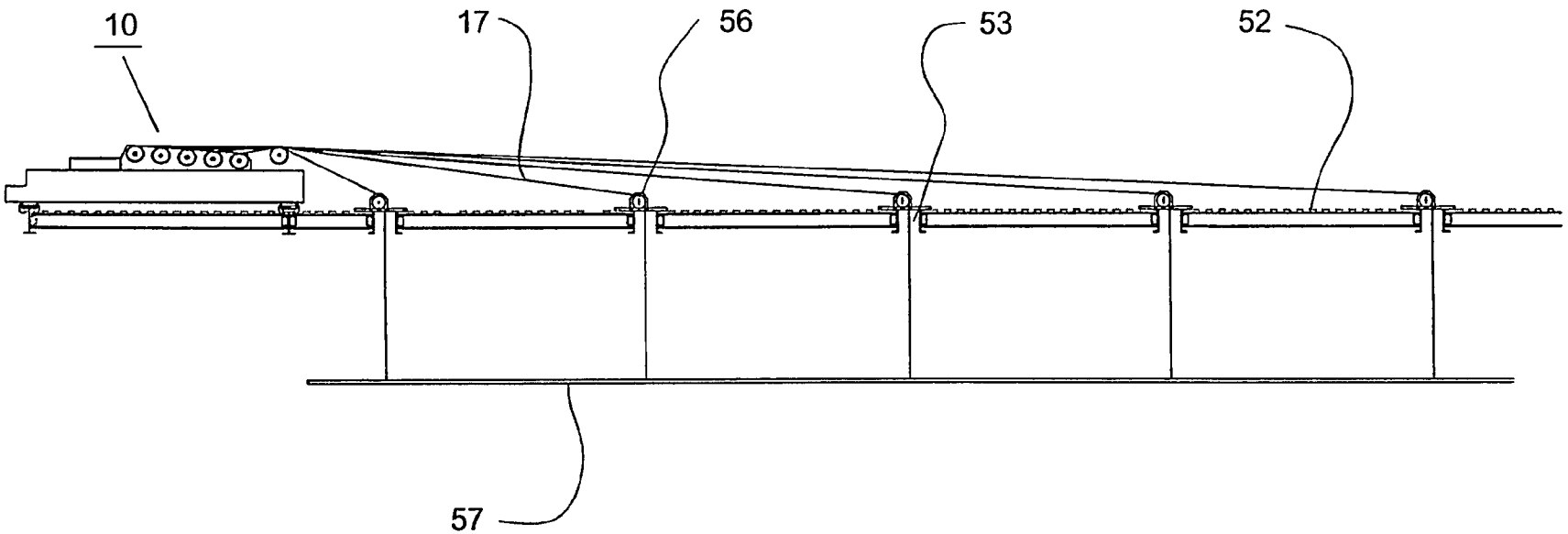
FIG. 14 is a side view of a gridiron and fly set with the improved winch mounted on the gridiron.

FIG. 14 shows another type of installation of the improved winches 10 into a facility. The improved winches 10 are installed at the gridiron 52 level at one or both (not shown) sides of the stage. The cables 17 pass from the improved winch 10 directly over the loft blocks 56 (mounted on the grid wells 53) down to the pipe batten 57. Note that this type installation in the new theaters eliminates the need for head blocks 55 shown on FIG. 13. It has also the advantages described under FIG. 13 for refurbishing the existing theaters.

Figure 15:
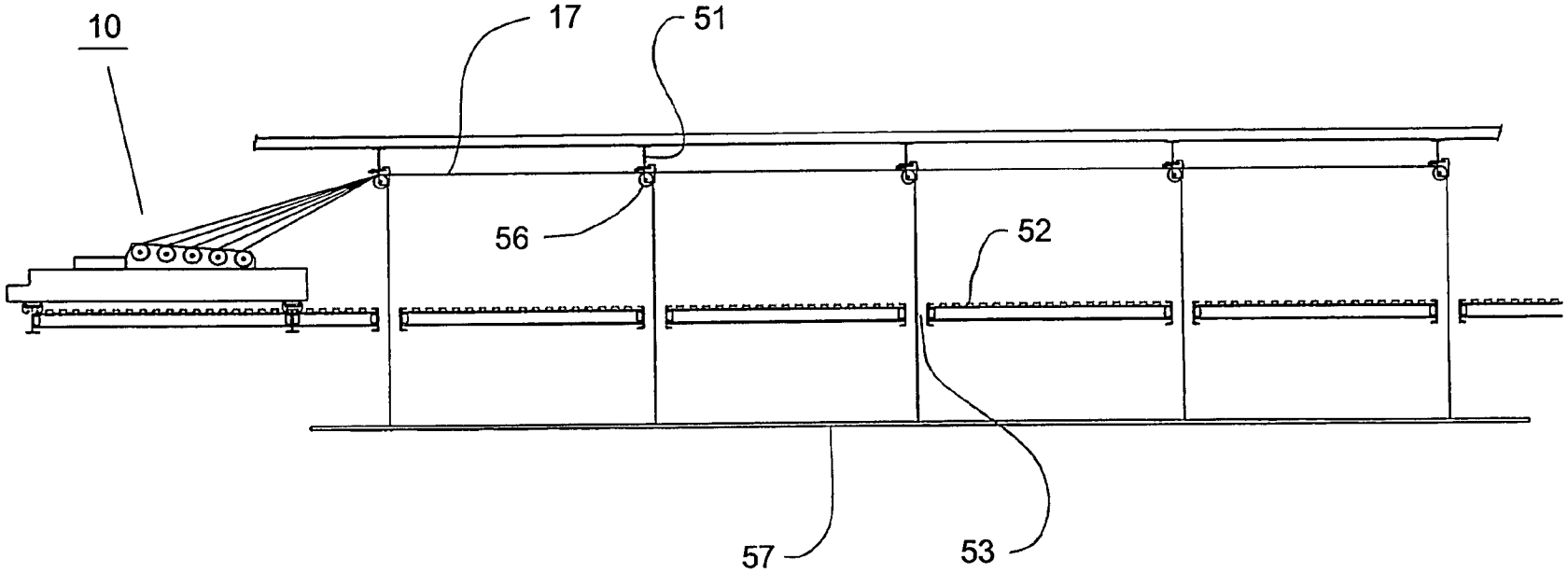
FIG. 15 is a side view with the improved winch mounted on the gridiron with loft blocks under-hung from overhead roof or ceiling beams.

FIG. 15 shows a type of installation where the winches 10 are mounted on the gridiron at one or both sides (not shown) of the stage and the loft blocks 56 are mounted to the underside of the roof or ceiling beams 51, which are located above the gridiron wells 53. The cables 17 pass from the winch 1 directly over the loft blocks 56 and down through the grid wells 53 to the pipe batten 57.

Figure 16:
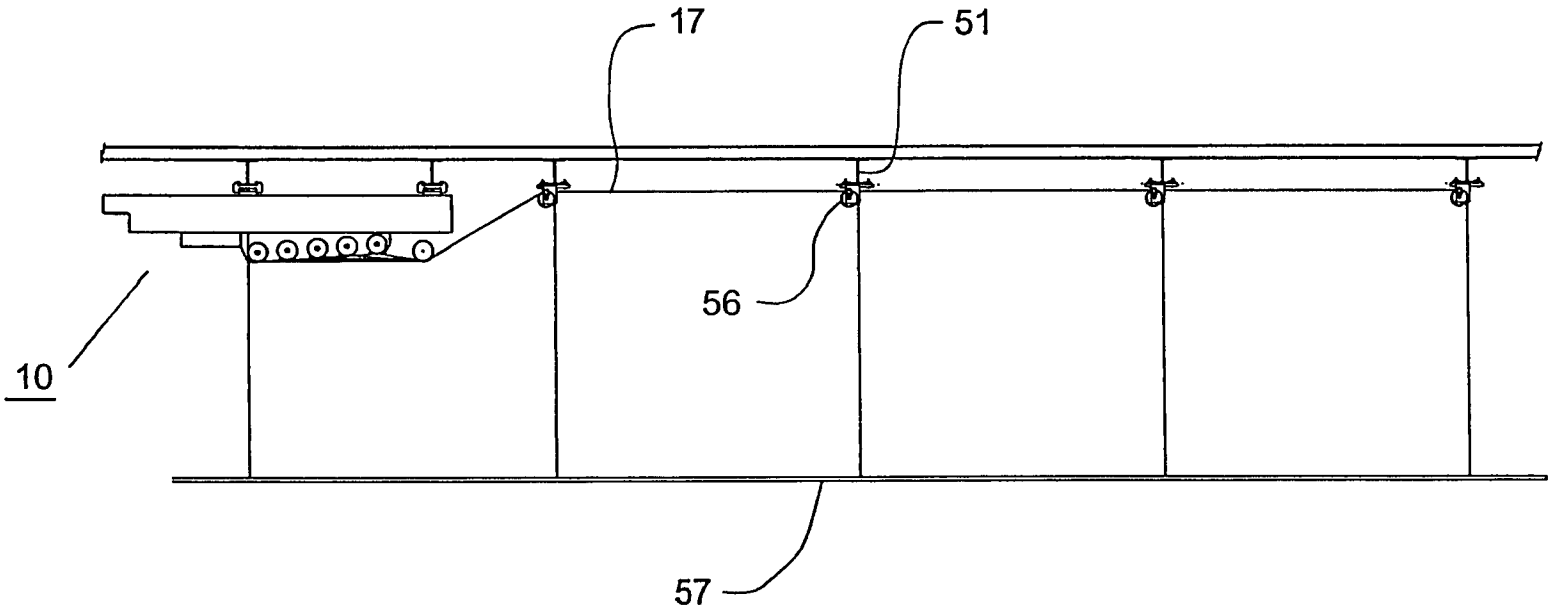
FIG. 16 is a side view of an under-hung fly system from the facility structure with the improved winch under-hung from the overhead beams.

FIG. 16 shows yet another type installation in a different facility where the improved winches 10 are under hung from the stage house overhead beams 51 and installed between the overhead beams 51. One cable 17 can be dropped directly from the improved winch 10 to the pipe batten 57 while the other cables 17 pass over the loft blocks 56 installed and connected to the stage house overhead beams 51. This type of installation is particularly useful for many small theaters, which do not have gridirons. It can be also used in the theaters with gridiron in order to keep the gridiron clear from horizontal cable 17 runs shown on FIG. 14. Instead of installing the improved winches 10 over the stage area as shown on FIG. 16, they can be mounted at the stage left or right areas and all cables 17 would then pass over the loft blocks 56 to the pipe batten 57. As another option, where the spacing of cables 17 along the length of pipe batten 57 is sufficiently close, (not shown), two cables 17 can be dropped directly from the improved winch 10 to the pipe batten 57.

Among the benefits of the invention over the previously built winches is the use of the tubular support enclosure, as a single structural member that performs a multitude of functions. It supports the winch unit mounted inside the tubular support enclosure, protects its movable parts, provides access for maintenance to the major movable parts, supports the cable guiding sheaves and interfaces with the mounting brackets for installation of the improved winch to the facility structure. An advantage is that the tubular support enclosure can be produced as a one piece aluminum extrusion with all winch support ribs, guiding surfaces mounting bracket interfaces and other interface items formed as part of the extrusion. This minimizes the fabrication and assembly, requirements and reduces the cost.

Another important advantage is that the improved winches in this invention can be installed in a facility close to each other because the tubular support enclosure protects the moving parts of the adjacent winches from interfering with each other and all moving parts are confined within the volume previously defined. The desired 8-inch fly set spacing can be achieved with the improved winches installed in a single row, side by side, which is not possible with the currently available winches. This feature is especially beneficial for rehabilitation of the existing theaters, which use manually operated counterweight fly sets, where the improved winches can be installed to the wall that is used for guiding the counterweights. The improved winches would then be accessible for maintenance from the existing platforms used for loading the counterweights or from the stage floor.

In addition, the versatile improved winch can be installed in horizontal position on the gridiron level or above. It can be hung from the overhead beams above the gridiron or in the theaters which do not have gridirons. The improved winch can also be mounted in tilted positions where required. It can be mounted at either side of the stage or over the performing area. The protection provided to the critical moving components by the structurally sound tubular support enclosure simplifies the handling of the improved winch during its installation.

Yet another advantage of the invention is that easy access is provided for removal and replacement of the fly set cables through the openings in the mounted tubular support enclosure, which together with all the cable guiding sheaves are accessible when the inner side plate of the sheave housing is removed. This feature is also beneficial for rehabilitation of the existing theaters, which use manually operated counterweight fly sets. The existing loft blocks, head blocks, cables and pipe battens can be reused by simply disconnecting the cables from the counterweights and reconnecting them to the improved winches after installation of the winches.

The improved winch also improves personnel safety, because contrary to the currently available winches, with covers over their moving parts, which may be removed and left open, all the major moving parts of the improved winches are inside the tubular support enclosure, not accessible to the personnel during winch operation.

Additional safety is provided by mounting the over-speed brake to the opposite end of the drum from its drive end, so that in case of motor, motor brake, or the gear reducer of the drive shaft key failure, the overs-peed brake would still stop the drum and support the objects hung from the winch. The tubular support enclosure would also contain the parts which may break off the winch unit in case of a catastrophic failure of the drive train and prevent them from falling.

It will also be appreciated that the invention is not limited to raising and lowering scenic elements in the theater, but can also be used in any facility with a need for raising and lowering any object, such as, for example, objects in a theme park.

The term "facility" has been used above to designate a building made up of the usual fixed structural members, such as beams, etc., and the tubular enclosure housing and supporting the winch unit typically is bolted at least at one end to a fixed structural member of the facility. However, while this is the more normal application of the invention, it is possible that in certain special cases the tubular enclosure housing and supporting the winch unit can be attached to a movable member in turn movably mounted to the facility. An example would be to mount the tubular enclosure housing and supporting the winch to a carriage riding on rails fixed to the facility to allow the load to be moved with the carriage or the carriage with winch to the location of the load. The inventive winch system is otherwise identical in this application, and thus "facility" should be interpreted to include not only fixed structural members of a building but also movable members connected to the building.

While the invention has been described in connection with preferred embodiments, it will be understood that modifications thereof within the principles outline above will be evident to those skilled in the art and thus the invention is not limited to the preferred embodiments but is intended to encompass such modifications.

What is claimed is:

1. An improved motorized winch for raising and lowering objects by means of cables with respect to a facility, comprising:

an elongated tubular support enclosure having a longitudinal direction and having means for mounting in a fixed position with respect to the facility, the tubular support enclosure having top, bottom, and side walls extending in the longitudinal direction, cable guiding means for receiving and guiding cables and mounted in a fixed position with respect to and supported by the tubular support enclosure on the top or bottom wall of the tubular support enclosure, the supporting top or bottom wall having access openings for passage of cables, a winch unit mounted inside, to, and supported by the tubular support enclosure, the winch unit comprising:

an elongated drum having a longitudinal axis extending in the longitudinal direction and having on its outside a helical groove configured to receive adjacent strands of a cable and mounted for rotation about and translation relative to its longitudinal axis on supports inside the tubular support enclosure and with respect to the tubular support enclosure, one or more cables engaging the drum grooves and passing from the outside of the drum through the access openings in the supporting top or bottom wall to and over the cable guiding means to the object, each cable when wound up on the drum occupying an axially-extending section having a given length of the drum grooves, drive means for rotating the drum, the top, bottom, and side walls of the tubular support enclosure extending at least over the drum in the longitudinal direction, said drum, and cables being connected to the cable guiding means such that rotation of the drum causes each cable to wind or unwind on or off the drum grooves to move the object up or down with respect to the facility while simultaneously translating back and forth, parallel to its longitudinal axis, relative to the tubular support enclosure in synchronization with the rotation of the drum controlling the cable runs to their respective cable guiding means to achieve zero fleet angle while the drum is translated over the given length of the axially-extending section, the mounting of the winch unit inside the tubular support enclosure and the mounting of the cable guiding means being such that access for maintenance and repairs can be had to the cables, drive means and cable guiding means without removing the tubular support enclosure from its fixed mounting to the facility.

2. The motorized winch as claimed in claim 1, in combination with a facility, with the tubular support enclosure mounted to the facility or to a carriage on the facility, the overall length of the tubular support enclosure exceeding the combined length of the drum and drive means whereby the drum and drive means while translating during normal operation are confined within the tubular support enclosure.

3. A motorized winch as claimed in claim 1, wherein the cable guiding means is fixedly mounted on the tubular support enclosure.

4. A motorized winch as claimed in claim 3, wherein the cable guiding means comprises a common sheave housing mounted to the top or bottom wall of the tubular support enclosure and plural sheaves mounted into the common sheave housing in vertically ascending or staggered fashion so as to provide clearance between cables leaving the cable guiding sheaves.

5. A motorized winch as claimed in claim 4, wherein the common sheave housing comprises an outer side plate and inner side plate, one of the side plates being permanently fastened to the tubular support enclosure, the sheaves having shafts mounted on the said one of the side plates, the other of the side plates being removable such that when removed access is provided to the winch unit and to the cables.

6. A motorized winch as claimed in claim 3, wherein the cable guiding means comprises individual sheave housings mounted to the top or bottom wall of the tubular support enclosure each in a different angular orientation with respect to the top or bottom wall so as to provide clearance between cables leaving the cable guiding sheaves.

7. A motorized winch as claimed in claim 1, further comprising a screw axially aligned with the drum in such manner that the screw causes the rotating drum to translate along its longitudinal axis in synchronization with cables unwinding or winding on the drum so that the cables maintain their alignment with the cable guiding means.

8. A motorized winch as set forth in claim 1, further comprising a frame, a drive motor, a gear transmission connected to the drive motor, and an overspeed brake all mounted into the frame, said frame being mounted for translation back and forth along the longitudinal axis of the drum to and inside the tubular support enclosure, supported and guided by the tubular support enclosure.

9. A motorized winch as set forth in claim 8, where the translation of the frame, together with the drum, in the drum longitudinal direction is caused by a an interior threaded surface at one end of the drum, rotating together with the drum and engaging a screw which is non-rotatably mounted to the tubular support enclosure, so that during this translation the drum moves to surround the screw in a cavity inside the drum.

10. A motorized improved winch for raising and lowering objects as set forth in claim 8, where the translation of the frame together with the drum in the drum longitudinal direction is caused by a screw fixed to one end of the drum and rotating with the drum while engaging an interior threaded surface non-rotatably connected to the tubular support enclosure.

11. A motorized improved winch for raising and lowering objects as set forth in claim 7, wherein the drum, its drive motor and gear transmission are supported by a first guiding support at the drive end of the drum and by a second guiding support at the opposite end of the drum, both guiding supports being connected to each other through the drum so that the entire assembly forms a winch unit and can translate parallel to the longitudinal axis of the drum, inside the tubular support enclosure.

12. A motorized improved winch for raising and lowering objects as set forth in claim 8, wherein the tubular support enclosure comprises inner opposed recessed sections, the frame comprising complementary elements movably engaging the opposed recessed sections for translation of the frame or base with the drum relative to the tubular support enclosure.

13. A motorized improved winch for raising and lowering objects as set forth in claim 1, further comprising brackets for mounting the tubular support enclosure to a facility, wherein the tubular support enclosure comprises outer recessed sections, the brackets comprising complementary elements movably engaging the outer recessed sections for supporting the tubular support enclosure with winch unit and for adjustment of the bracket spacing relative to the facility.

14. An improved motorized winch for raising and lowering objects with respect to a facility as set forth in claim 1, wherein:

the tubular support enclosure comprises connected top, bottom, and side walls which during operation enclose the winch unit and having means for connecting to the facility and means for access for maintenance and repairs, the mounting of the winch components and the cable guiding means being confined within a right quadrangular prismatic volume defined by the tubular support enclosure side walls and straight prolonged imaginary extensions of the side walls such that plural winches can be mounted side-by-side without winch component interference.

15. A motorized winch as claimed in claim 14, wherein the cable guiding means is mounted on the tubular support enclosure such that the cable-guiding means and the cables wholly remain confined within the said right quadrangular prismatic volume during operation of the winch.

16. A motorized winch as claimed in claim 14, further comprising a sensor mechanism operably connected to the drive means or drum for sensing rotation, the sensor mechanism being mounted to the tubular support enclosure and being confined within the said right quadrangular prismatic volume.

17. An improved motorized winch for raising and lowering objects with respect to a facility, comprising:

a tubular support enclosure having a longitudinal direction and having top, bottom and side walls extending in the longitudinal direction and means for connecting to the facility and means for access for maintenance and repairs, cable guiding means mounted to and supported by the top or bottom wall of the tubular support enclosure for receiving and guiding cables, a winch unit mounted inside and supported by the tubular support enclosure, the winch unit comprising:

an elongated drum having grooves and having a longitudinal axis and mounted for rotation and translation relative to its longitudinal axis on slidable or rollable supports inside the tubular support enclosure and in its longitudinal direction, the top, bottom, and side walls of the tubular support enclosure extending at least over the drum in the longitudinal direction, one or more cables engaging the drum grooves and passing from the outside of the drum through access openings in the supporting top or bottom wall over the cable guiding means to the lifted object, drive means for rotating the drum, said drum, cables and cable guiding means being connected such that rotation of the drum causes the cables selectively to wind or unwind on or off the drum grooves to move the object up or down with respect to the facility while simultaneously translating back and forth, parallel to its longitudinal axis, relative to the tubular support enclosure in synchronization with the rotation of the drum controlling the cable runs to their respective cable guiding means to achieve zero fleet angle performance, the tubular support enclosure being fixedly mounted to the facility, an axially-movable frame rollably or slidably mounted within and supported by the tubular support enclosure, the drum and motor drive being mounted on the frame and axially-movable with the frame for access for maintenance and repairs.

18. A motorized winch as claimed in claim 17, wherein the cable guiding means is fixedly mounted on the tubular support enclosure, and the drum, cables and cable guiding means are connected so as to maintain the zero fleet angle as the object is raised and lowered.

19. The motorized winch as claimed in claim 17, wherein the tubular support enclosure and the cable-guiding means have a maximum width measured transverse to the longitudinal direction of the tubular support enclosure of 8 inches.

* * * * *